US006059101A

United States Patent [19]

Gambardella et al.

[11] Patent Number: 6,059,101

[45] Date of Patent: May 9, 2000

[54] DISPLAY PACKAGE FOR A MEDIA ITEM

[75] Inventors: John A. Gambardella; Melanie Anne Moore, both of Charlotte, N.C.; Tim Whitson, Lexington, Mass.

[73] Assignee: Cadmus Communication Corporation, Richmond, Va.

[21] Appl. No.: 09/197,994

[22] Filed: Nov. 23, 1998

Related U.S. Application Data

[63] Continuation-in-part of application No. 08/859,065, May 20, 1997.

[51] Int. Cl.[7] ..... B65D 85/57

[52] U.S. Cl. ..... 206/308.1; 206/312; 206/758; 206/762; 40/751; 40/789

[58] Field of Search ..... 206/307, 308.1, 206/308.3, 309, 312, 736, 758, 762, 775; 40/750, 751, 788, 789, 539, 124.16, 610

[56] References Cited

U.S. PATENT DOCUMENTS

| | | | |
|---|---|---|---|
| 1,347,269 | 7/1920 | Greble | 40/789 |
| 3,057,470 | 10/1962 | Heiber | 206/312 |
| 3,549,225 | 12/1970 | Scaccia | 206/308.1 |
| 4,582,286 | 4/1986 | Mancuso | 248/459 |
| 5,479,732 | 1/1996 | Burtch et al. | 40/124.1 |
| 5,608,977 | 3/1997 | Burtch et al. | 40/124.15 |
| 5,613,311 | 3/1997 | Burtch | 40/124.15 |
| 5,711,101 | 1/1998 | Mueller et al. . | |
| 5,732,491 | 3/1998 | Burtch | 40/124.16 |
| 5,740,957 | 4/1998 | Wenkman . | |
| 5,746,689 | 5/1998 | Murphy . | |

*Primary Examiner*—Paul T. Sewell
*Assistant Examiner*—Nhan T. Lam
*Attorney, Agent, or Firm*—Alston & Bird LLP

[57] ABSTRACT

A display package for a media item includes a base having opposing halves each formed of a pair of spaced apart upper and lower panels hingedly connected together along outer ends of the panels, the upper panels also being hingedly connected together along inner ends thereof. Central portions of the inner ends of the upper panels are spaced apart from each other to define an elongate slot therebetween. The display carrier also includes an upright body portion comprising a first body panel hingedly connected along a first edge thereof to an inner edge of a first one of the lower panels, and a second body panel hingedly connected to the first body panel along a second edge of the first body panel. The second body panel overlies the first body panel and is secured thereto to define a pocket adapted for reception therein of a graphic media item. The body panels extend upwardly through the slot and one of the first and second body panels has a window therein for viewing of the graphic media item.

17 Claims, 14 Drawing Sheets

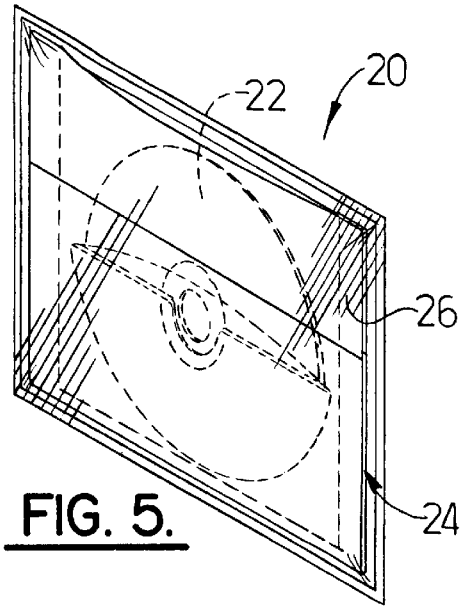
FIG. 5.
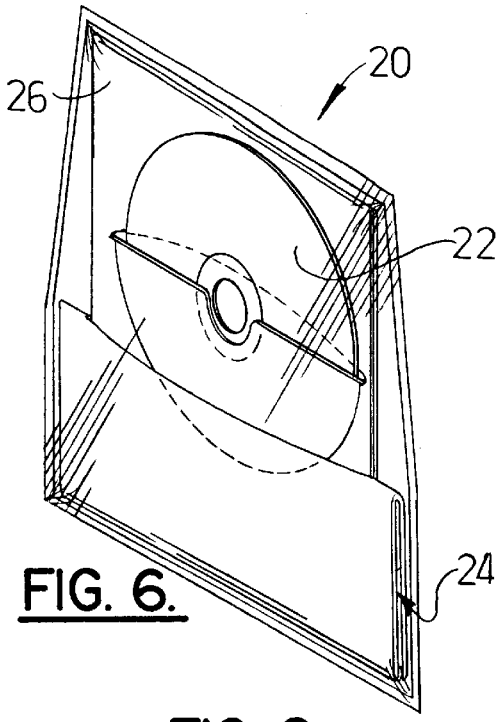
FIG. 6.
FIG. 7.
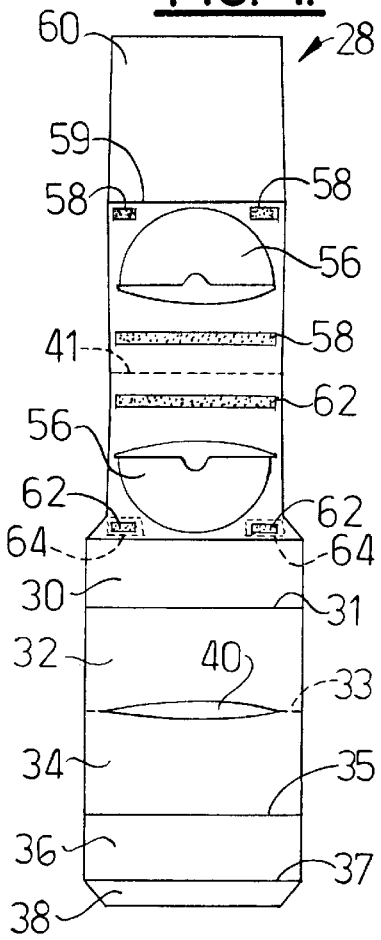
FIG. 8.
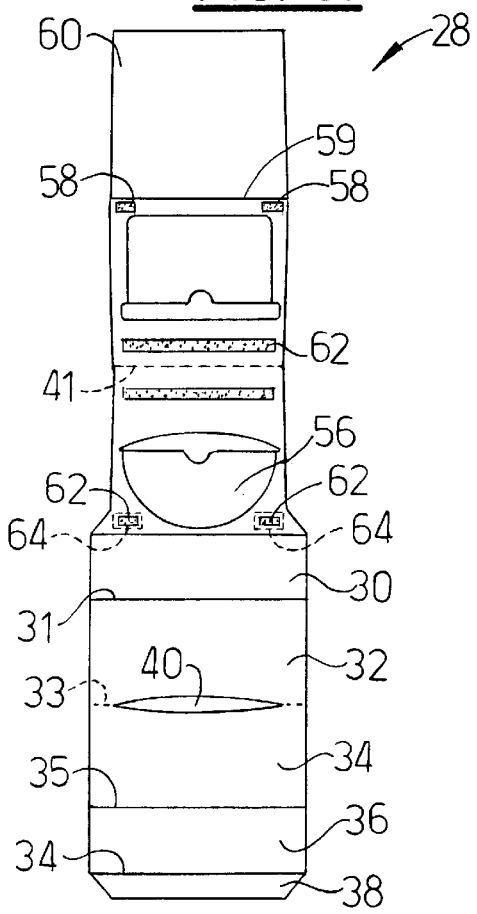

DISPLAY PACKAGE FOR A MEDIA ITEM

CROSS REFERENCE TO RELATED APPLICATION

This application is a continuation-in-part of copending U.S. patent application Ser. No. 08/859,065, filed on May 20, 1997.

FIELD OF THE INVENTION

The present invention relates generally to a display package, and, more particularly, to a display package for a media item such as an optical disk, magnetic media storage disk, photograph, or the like.

BACKGROUND OF THE INVENTION

The ability to pleasingly display a product in a package so as to entice consumers to purchase the product, the ability to adequately protect the product in the package during shipment and handling, and environmental concerns over the waste of materials used to manufacture such packages are, in today's world, constantly in conflict. This is especially true with regard to items such as plastic cards, sample products, computer games, and music discs, collectively referred to as media items. In each case, the seller or provider of the media item is interested in providing the consumer with a package which is capable of protecting the media item from damage during shipment and handling, such as on the store shelf, and providing a package which is sufficiently attractive so as to entice the consumer to purchase the product.

Media items, such as video games, are frequently packaged in carriers, such as a paperboard box, which often have dimensions exceeding 8×2½×9 inches. These carriers are used even though a video game or similar computer program typically includes either a CD ROM disc having a diameter of less than 5" or a 3½" computer diskette, and an instructional booklet of usually no more than twenty pages. The problem is made worse because in order to retain the CD ROM and the related instructional booklet in place, additional material, often paperboard or corrugated, is placed inside the carrier. Although the marketing and promotional requirements are well met by such large carriers, the waste of materials is dramatic.

In the music industry, promotional CDs are frequently packaged in plastic jewel cases. Although the jewel cases are useful in protecting the CD from damage during shipment and handling, because of their construction, they are difficult to open, often break, and are not environmentally friendly.

Similarly, in the food and beverage, and fragrance and cosmetic industries, prepackaged product samples are frequently inserted or secured, such as by stapling to cards which are used to ship these media items to retail outlets and/or consumers. Unfortunately, the shipping cards do not provide very good protection for or handsomely display the media item.

Prior to the advent of CDs, music was sold in the form of phonograph records. U.S. Pat. Nos. 3,057,470 and 3,549,225 disclose the use of phonograph holders which receive a protective envelope surrounding the phonograph record so that in a shipping and/or storage position the protective envelope is covered by the holder to protect the protective envelope. In addition, each patent discloses the holder in an erected position which presents the protective envelope in an upright position to allow the phonograph record to be removed and inserted from the protective envelope via an opening at the top of the protective envelope. The purpose of the phonograph holders is in part to allow handling of the phonograph record by a peripheral edge thereof to thereby minimize damage thereto. However, each of the patents requires the use of a protective envelope to be secured to a central portion of the holder and, based on the configuration of the holders, each requires access to the protective envelope by means of a top opening. Furthermore, the phonograph record requires the additional protection of an outer layer, such as a transparent layer, to prevent the phonograph record from falling out of the protective envelope and the holder if the holder is inadvertently inverted or jostled during shipment and/or handling.

Consequently, the available approaches used to retain a media item for protection during shipment and handling and for handsomely advertising and/or displaying the media item, at its destination, fail in either or both of the objectives set forth above. In addition, the environmental impact of each of the aforementioned approaches is less than desirable.

It is also sometimes desirable to be able to display a graphic media item such as a photograph, collectible card (e.g., baseball card), or other generally flat graphic media item, either in a store or in a consumer's home, office, etc. Typically, such graphic media items are displayed in frames that are relatively bulky and expensive. Accordingly, it would be desirable to provide an alternative display package capable of displaying a graphic media item and which is less bulky and less expensive than a conventional frame.

SUMMARY OF THE INVENTION

The above and other objects are met and other advantages are obtained by the present invention which provides a display carrier for media items comprising a base having opposing halves each formed of a pair of spaced apart upper and lower panels hingedly connected together along their outer ends. Respective upper panels are hingedly connected together along their inner ends. Central portions of the inner ends of the upper panels are spaced apart from each other so as to define an elongate slot. An upright body is connected to the base and extends upwardly therefrom through the slot. The body comprises a plurality of opposing panels which define a pocket adapted for reception therein of a media item.

Preferably the pocket includes an access opening in a medial portion thereof to allow for inserting and removing the media item from the display carrier. It is advantageous for the plurality of panels to define one or more pockets on one or more of the opposed sides of the body to receive and retain one or more media items.

Embossing of a portion of the pocket, in conjunction with an elliptical shape of the elongate slot, assists in loading a media item into the display carrier when in a collapsed position. The embossing also assists in reducing damage to the media item caused by frictional engagement between the display carrier and the media item. The shape of the pocket allows the media item to be securely retained within the display carrier even after a protective wrap has been removed.

As is readily understood by those skilled in the art to which the invention relates, it is important for the upper and lower base panels to have a collective width at least substantially equal to a length of the body so that the body and any media item contained therein is substantially encased thereby when the display carrier is in a collapsed position. To provide additional protection to the display carrier and the media item during shipment, it is beneficial to enclose or encase the display carrier and the media item in a protective wrap.

Although the carrier can be manufactured from several pieces, it is advantageous to manufacture the display carrier from a unitary sheet of a material having a uniform thickness.

At least one of the plurality of body panels and preferably each of the plurality of body panels has outwardly downwardly divergingly opposed side edges to assist in retaining the display package in one of a plurality of display positions. Due to the progressively increasing frictional engagement between the elongated slot formed in the base and the divergingly angled side edges, the display package is capable of being positioned in at least two different display positions.

An open display position is preferably one wherein the pair of lower panels are generally in longitudinal alignment so as to provide a generally triangular base, when viewed from an end thereof, to support the display package on a generally flat surface. The open display position preferably comprises a triangle. Such a configuration provides both a stable support for the media item and a large display area on which advertising and/or informational material may be applied.

Advantageously, a compact display position is one wherein the outer ends of the pair of spaced apart upper and lower panels are located adjacent one another. In this position, the display package can be inserted into a groove or similar receiving slot, such as on a store shelf, to be used as a shelf talker, or be used to stack a number of packages for display in a confined area without removing the protective wrap. Alternatively, because of a mounting aperture located adjacent an upper end of the body when in one of the erected positions, the display package can be readily mounted to a wall or hung by a string from above.

Ideally the blank for forming a display carrier comprises a generally rectangular base having a plurality of panels, such that a first base panel and a second base panel are hingedly connected along a common fold line. A third base panel and a fourth base panel are similarly hingedly connected along a common fold line. A center portion of the second base panel and the third base panel preferably define an elongated slot. A connecting panel is advantageously hingedly connected to the base panel along a common fold line. The blank also includes a body having a plurality of panels, such that a first body panel and a second body panel are hingedly connected along a common fold line. One of the first body panel and the second body panel beneficially define an access opening therein along a medial portion thereof. It is also possible to provide a plurality of juxtaposed body panels to form a pair of pockets for each receiving one or more media items. As a result of the features of the present embodiments of the invention, the display package is extremely versatile.

In another embodiment of the present invention, there is provided a display carrier for media items comprising a base having opposing halves each forming a pair of spaced apart upper and lower panels hingedly connected together along their outer ends. Respective upper panels are hingedly connected together along their inner ends. The central portions of the inner ends of the upper panels define an elongated slot. The display carrier provides opposed body forming panels connected to each end of the non-adjacent base panels, which body panels are joined together and extend upwardly therefrom through a slot created between the two adjacent panels forming the bottom of the base. The body forming panels, when adhesively affixed together, define a pocket adapted for reception of a media item.

In addition, a blank for forming the display carrier is provided which comprises a generally rectangular base having a plurality of panels, such that a first panel and a second panel are hingedly connected along a common fold line. A third base panel and a fourth base panel are similarly hingedly connected along a common fold line. A central portion of the second base panel and the third base panel preferably define an elongated slot. A first body panel is advantageously hingedly connected to a base panel along a common fold line. A second body panel is likewise hingedly connected to the base panel at the opposite end of the blank.

The invention also provides a display carrier for a graphic media item such as a photograph, collectible card, or the like. Thus, in accordance with a further preferred embodiment of the invention, a display carrier comprises a base having opposing halves each formed of a pair of spaced apart upper and lower panels hingedly connected together along outer ends of the panels, the upper panels also being hingedly connected together along inner ends thereof. Central portions of the inner ends of the upper panels are spaced apart from each other to define an elongate slot therebetween. The display carrier also includes an upright body portion comprising a first body panel hingedly connected along a first edge thereof to an inner edge of a first one of the lower panels, and a second body panel hingedly connected to the first body panel along a second edge of the first body panel. The second body panel overlies the first body panel and is secured thereto to define a pocket adapted for reception therein of a graphic media item. The body panels extend upwardly through the slot and one of the first and second body panels has a window therein for viewing of the graphic media item.

Preferably, the first edge of the first body panel along which the second body panel is hingedly connected comprises a vertically extending side edge of the first body panel such that a slot is defined between top edges of the first and second body panels for insertion of a graphic media item therethrough. Alternatively, however, the body panels may be hingedly connected along their top edges such that the slot for insertion of the graphic media item is between opposing side edges of the body panels.

In a preferred embodiment of the invention, the upper and lower panel of each of the halves of the base have a combined length which is substantially the same as that of the body portion such that the display carrier is foldable into a flat orientation with the two halves of the base substantially entirely enclosing the body portion therebetween. Additionally, the upper panels have equal lengths not substantially greater than about one-half a length of the body portion such that at least about three-quarters of the length of the body portion extends above the elongate slot. Thus, the base affords an unobstructed view of the graphic media item.

Advantageously, to facilitate assembling the display carrier, the carrier includes an attachment flap hingedly connected to one of the first and second body panels along an edge thereof opposite the hinged connection of the first and second body panels. The attachment flap is secured to the other of the first and second body panels for maintaining the body panels in opposing relation to define the pocket for the media item.

The invention also encompasses a blank formed from a unitary sheet material for forming a display carrier for a graphic media item, which comprises a base-forming portion defined by a plurality of serially connected panels including first and second base panels hingedly connected to each other along a common fold line and third and fourth base panels hingedly connected to each other along a common fold line. The second and third base panels are hingedly connected to each other along a common fold line, and an elongate slot is formed between the second and third base panels. The blank also includes a body-forming portion comprising a first body panel hingedly connected along a common fold line to the first base panel, and a second body panel hingedly connected along a common fold line to the first body panel, the body-forming portion having a width less than the length of the slot so as to permit the body-forming portion to extend through the slot. One of the first and second body panels has a window therein for viewing of a graphic media item retained between the body panels when the blank is assembled to form a carrier.

Preferably, the blank also includes an attachment flap hingedly connected to the first body panel along an edge thereof opposite the edge connected to the second body panel. The blank advantageously also includes a connecting panel hingedly connected to the fourth base panel and forming a lengthwise extremity of the blank.

BRIEF DESCRIPTION OF THE DRAWINGS

Some of the objects, features and advantages of the present invention having been stated, others will appear as the description proceeds, when taken in conjunction with the accompanying drawings in which;

FIG. 5 is a side view in perspective of the display package in the collapsed position covered by a protective wrap, showing the media item in phantom;

FIG. 6 is a side view in perspective of the display package shown in the compact display position covered by a protective wrap;

FIG. 7 is a top plan view of a blank used in forming a display carrier having pockets located on opposed sides of the body in accordance with a preferred embodiment of the invention;

FIG. 8 is a top plan view of another embodiment of a blank used in forming a display carrier having differently shaped pockets located on opposed sides of the body;

DESCRIPTION OF PREFERRED EMBODIMENTS

The present invention will now be described more fully hereinafter with reference to the accompanying drawings, in which preferred embodiments of the invention are shown. This invention may, however, be embodied in different forms and should not be construed as limited to the embodiments set forth herein. Rather, the illustrative embodiments are provided so that this disclosure will be thorough and complete, and will fully convey the scope of the invention to those skilled in the art. Like numbers refer to like elements throughout.

Referring to FIGS. 1, 2, 5, and 6, a display package, generally indicated as 20, is shown having a media item 22, retained therein. As set forth herein, a media item includes, but is not limited to, electronic discs, music discs, computer diskettes, booklets, prepackaged food samples, prepackaged beverage samples, prepackaged cosmetic samples, prepackaged fragrance samples, prepackaged tobacco products, plastic and/or paper cards and photographs. The display package 20 includes a display carrier, generally indicated as 24, which is adapted to receive the media item 22. To protect the display carrier 24 and the media item 22 during shipment and handling, a wrap 26 is used to encase the display package 20. Typically, the wrap 26 is applied by shrink wrapping or the like so as to provide a plastic barrier to the elements. It is desirable for the wrap 26 to be transparent or at least translucent so that the display package 20 can be easily seen therethrough.

Figure 1:
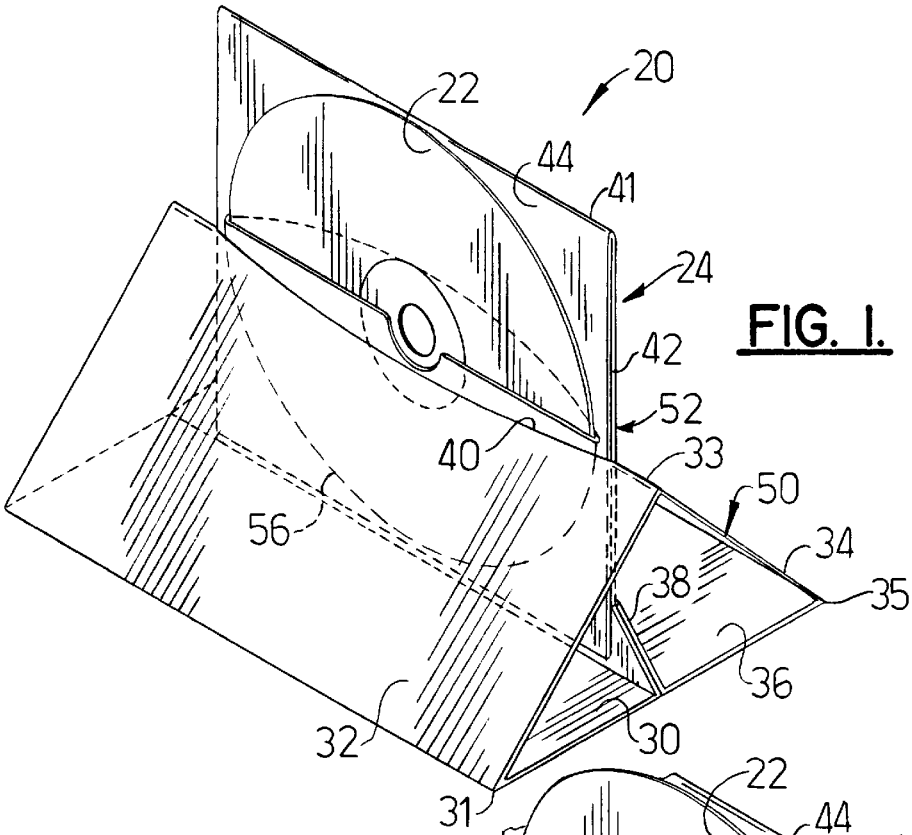
FIG. 1 is a perspective view of a preferred embodiment of a display package shown in an open display position in accordance with the present invention.
Figure 2:
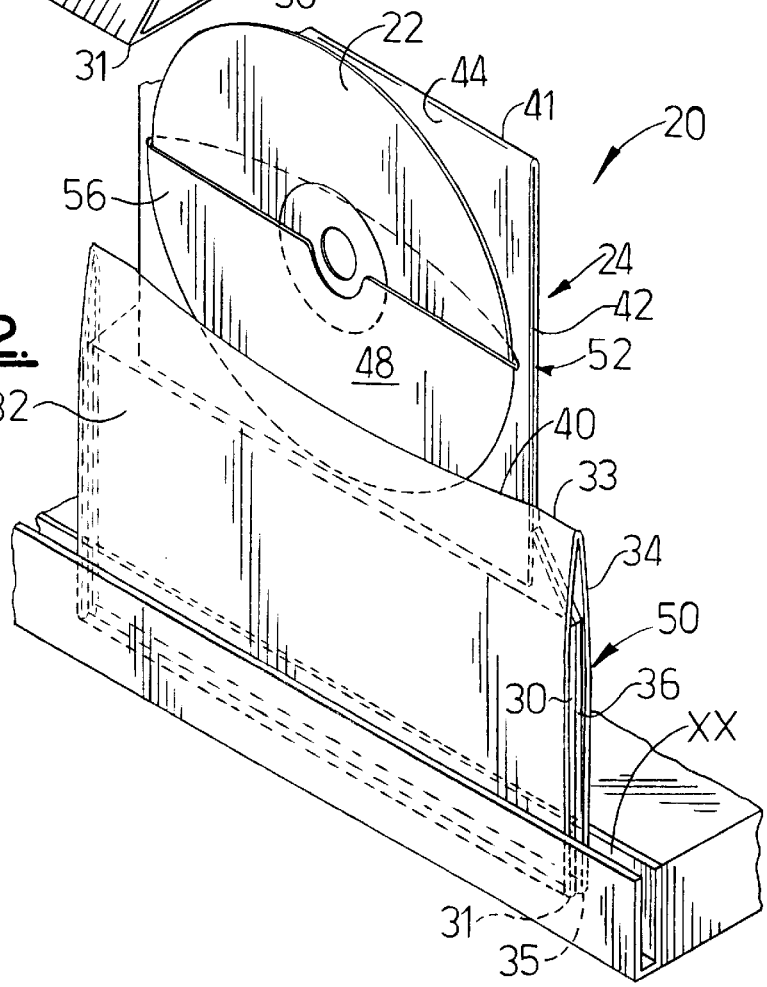
FIG. 2 is a view similar to that shown in FIG. 1 illustrating the display package in a compact display position.
Figure 3:
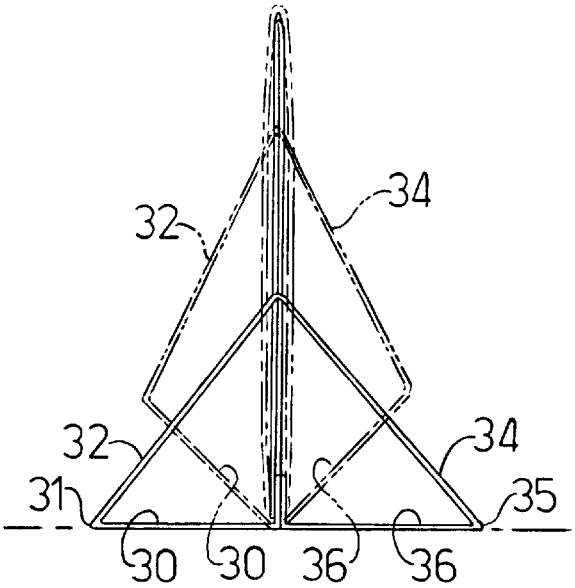
FIG. 3 is an end view of the display package shown in FIG. 1, illustrating, in phantom, the collapsed and intermediate positions of the display package as it moves from the collapsed position to the open display position.
Figure 9A:
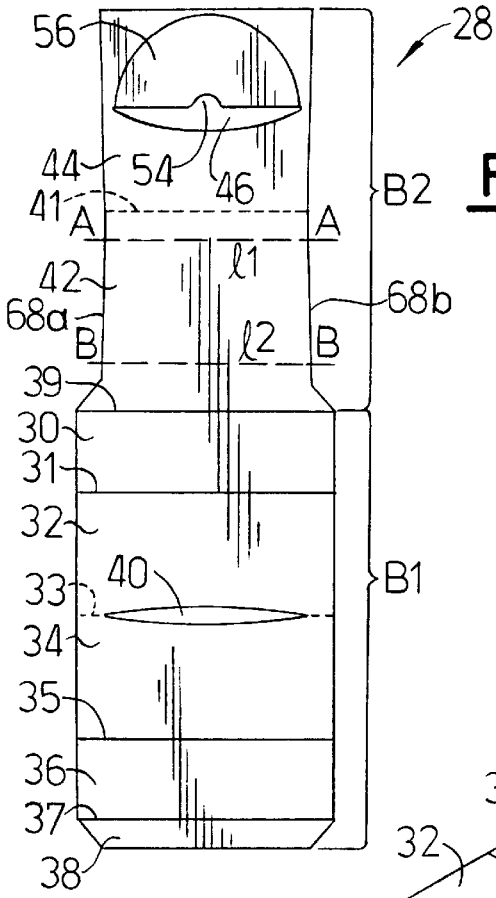
FIG. 9A is a top plan view of a blank used in forming a display carrier having a pocket located on one of the opposed sides of the body.

As best shown in FIGS. 1, 2, and 9A, the display carrier 24 of the present embodiment is formed from a blank, generally indicated as 28, which is made from a unitary material of uniform thickness. In this embodiment, the material is paperboard (12 or 14 point SBS C2S). It is to be understood that a different quality, color, or gauge of paperboard or alternative materials such as plastic or a light metal alloy, or a combination thereof, may be used to make the display carrier within the spirit of the invention, so long as the material used is capable of being cut and folded while retaining the desired shape of the display carrier. It is also to be understood that a coating or other surface treatment need not be used at all or may only be on one side of the paperboard without departing from the spirit of the invention.

The blank has a base forming portion $B^1$ and a body forming portion $B^1$. The base forming portion $B^1$ includes a plurality of serially arranged panels and has a generally rectangular configuration. A first base panel 30 is integrally formed and hingedly connected, along a common fold line 31, to a second base panel 32. The second base panel 32 is in turn integrally formed with and hingedly connected, along a common fold line 33, to a third base panel 34. The third base panel 34 and a fourth base panel 36 are integrally formed with and hingedly connected, along a common fold line 35, to each other. A connecting panel 38 is integrally formed with and hingedly connected, along a common fold line 37, to the fourth base panel 36. The connecting panel 38 forms an outer lengthwise extremity of the base forming portion $B^1$ and the blank 28. An elongate slot 40 is defined in a central portion between the second base panel 32 and the third base panel 34.

The body forming portion $B^2$ also has a generally rectangular configuration as shown in FIG. 9A. The body forming portion $B^2$ includes a first body panel 42 which is integrally formed with and hingedly connected, along a common fold line 39, to the first base panel 30. The first body panel 42 is also integrally formed with and hingedly connected, along a common fold line 41, to a second body panel 42.

In the embodiment shown in FIG. 9A, the second body panel 44 has a cutaway portion 46 which defines an access opening for a pocket 48 (see FIG. 12) formed by the first body panel 42 and the second body panel 44. In this instance, the second body panel 44 contains the cutaway portion 46 and therefore has less surface area than the first body panel 42, which has an uninterrupted surface area and thereby forms the back wall of the pocket 48. It is to be understood that the cutaway portion 46 may be of a wide variety of shapes without departing from the spirit of the invention. It is to also be understood that the pocket 48 may be of any desired size or shape so as to accommodate one or more media items 22 therein. As shown in FIG. 9A, the second and third base panels 32 and 34 are considerably longer than the first and fourth base panels 30 and 36. The benefit of such a configuration of the base forming portion $B^1$ is described in greater detail below.

In alternative embodiments of the blank 28, shown in FIGS. 7 and 8, the body forming portion $B^2$ also includes serially arranged panels and has a generally rectangular configuration. It is to be understood however, that in each embodiment of the blank 28 that the body panel which contains the cutaway portion 46 may have a different shape. For example, it is possible to round upper corners of the body panel or make similar variations in the shape of the body panels and still remain within the spirit of the invention.

Figure 9B:
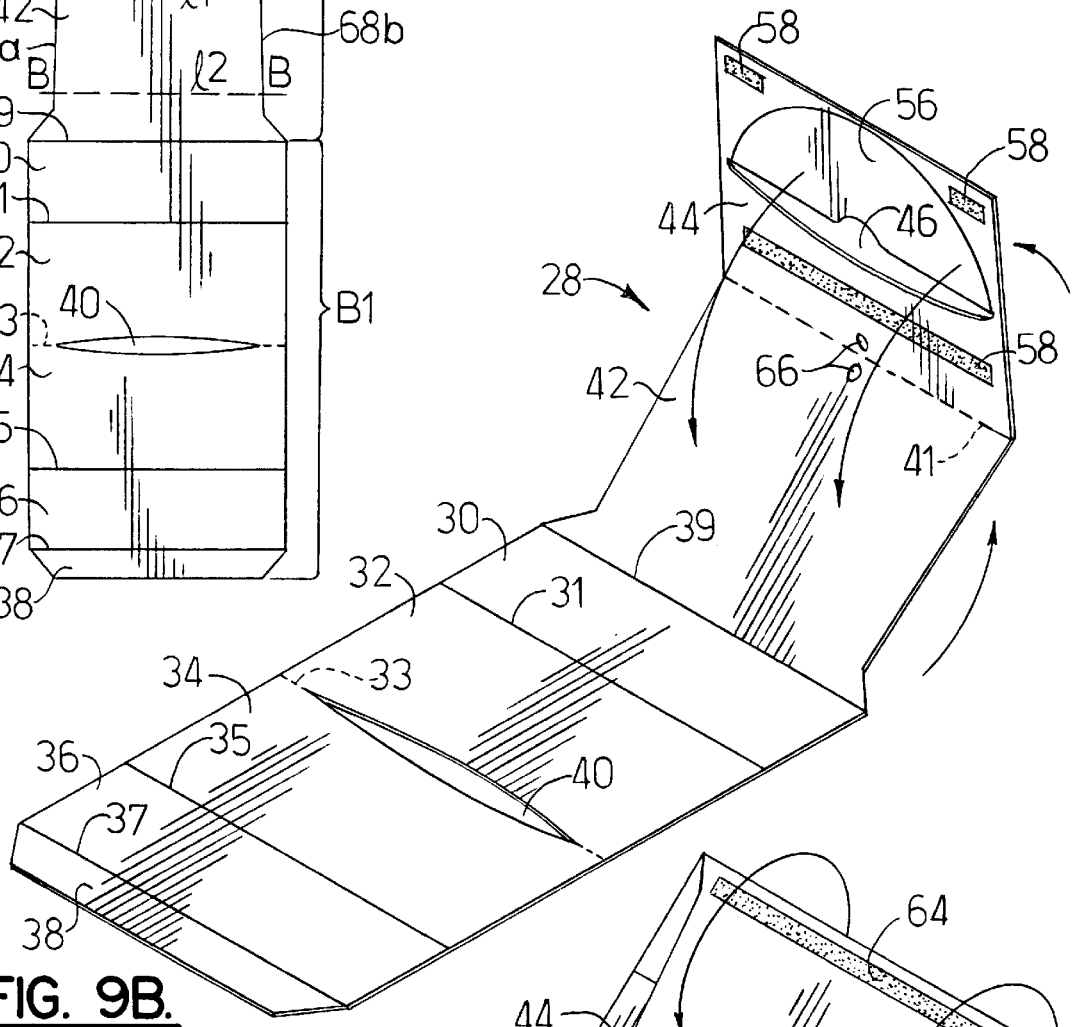
FIG. 9B is a side view in perspective of the blank shown in FIG. 9A illustrating gluing locations and the first fold to be made in forming the display carrier.
Figure 9C:
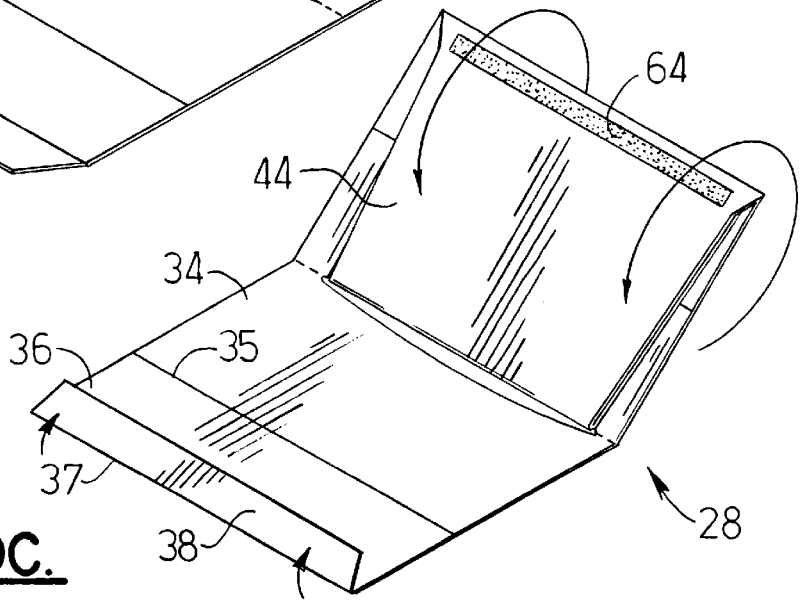
FIG. 9C is a side view in perspective of the blank shown in FIG. 9B illustrating additional gluing locations and the second fold to be made in forming the display carrier.
Figure 9D:
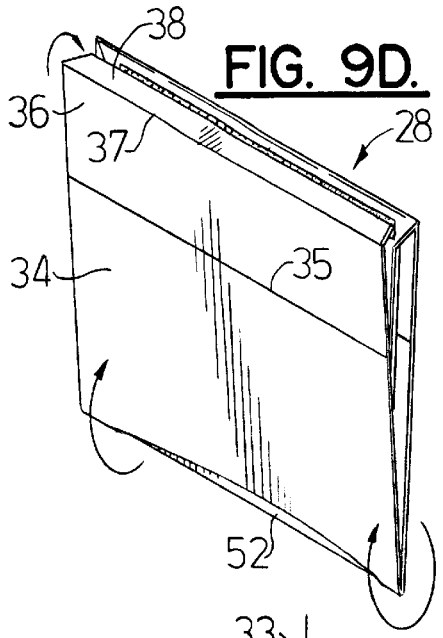
FIG. 9D is a side view in perspective of the blank shown in FIG. 9C illustrating the final fold to be made in forming the display carrier.
Figure 9E:
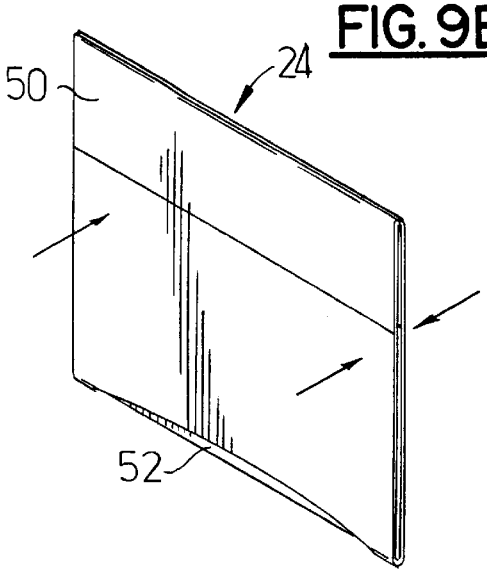
FIG. 9E is a side view in perspective of the blank shown in FIG. 9D once the folding and gluing have been completed.
Figure 10A:
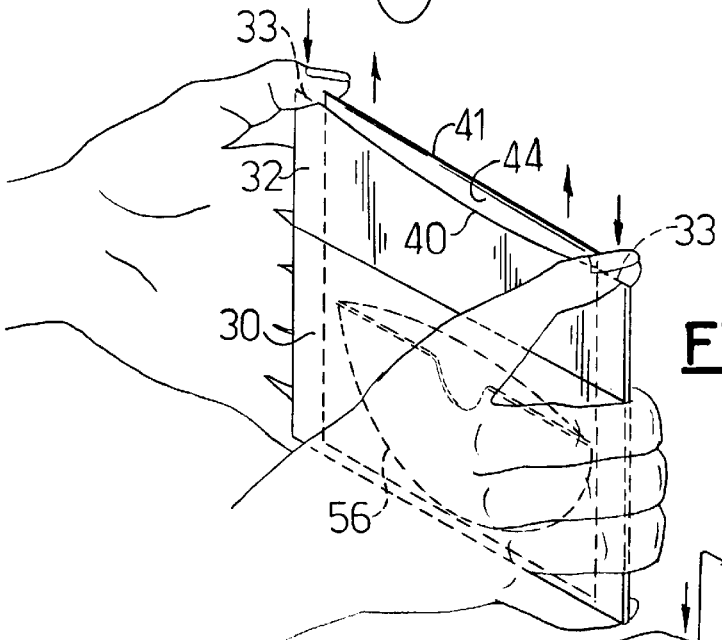
FIGS. 10A and 10B are each a side view in perspective and partially in phantom of an embodiment of a display carrier in accordance with the invention, illustrating how the display carrier moves from the collapsed position to one of the display positions.
Figure 10B:
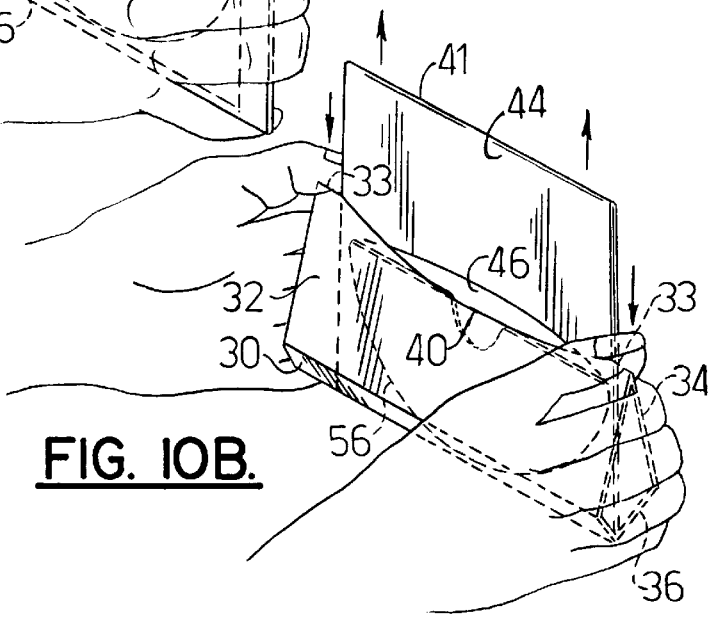
Figure 11A:
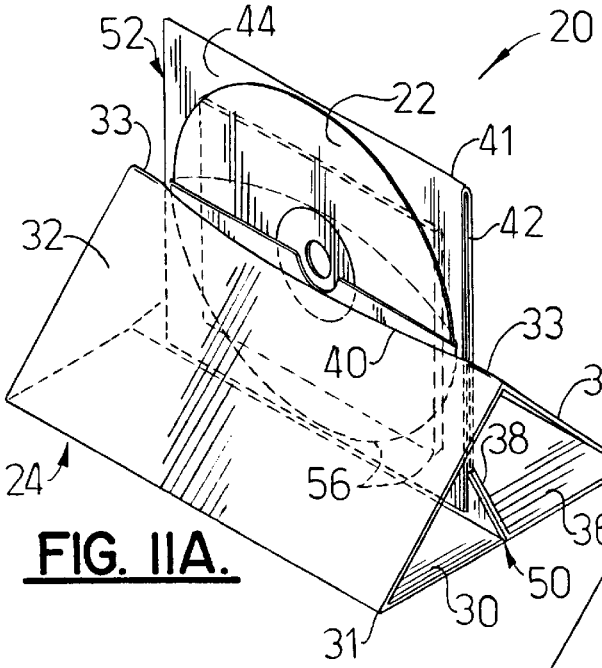
FIG. 11A is a side view in perspective and partially in phantom showing a display carrier formed from a blank similar to that shown in FIG. 8, having a pair of opposed pockets of different shapes to receive a different media item, namely, a CD and a booklet received in each pocket.
Figure 11B:
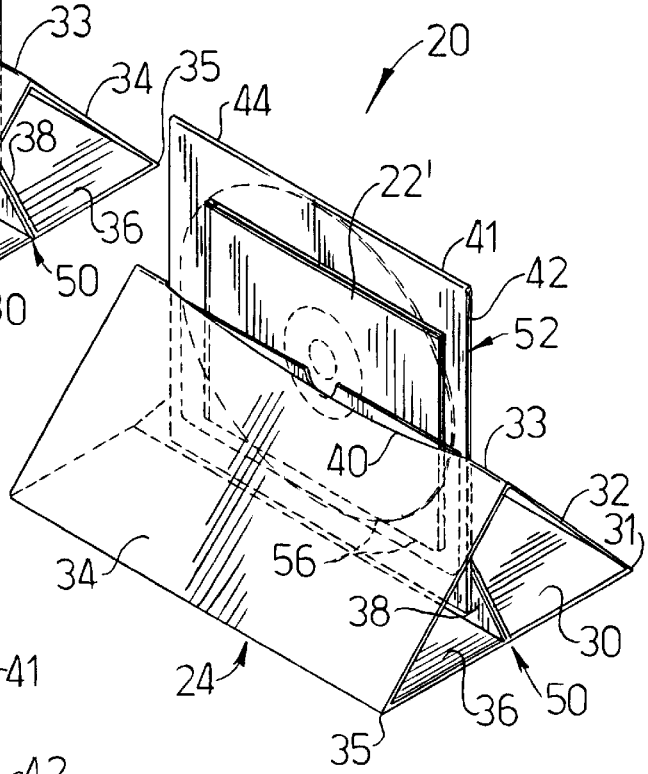
FIG. 11B is a side view in perspective similar to that shown in FIG. 11A illustrating an opposed face of the display package.

By comparing FIGS. 9A through 9E, it may be seen how the blank 28 is folded and glued to form the display carrier 24. As shown in FIG. 9B, glue or other adhesive is applied to first glue locations 58 on the second body panel 44. Once the glue has been applied, the second body panel 44 is folded along the common fold line 41 into registration with the first body panel 42. The common fold line 41 is creased to enable the second body panel 44 to fold onto the first body panel 42 while retaining a secure upper portion or tip formed by the common fold line 41.

Figure 12:
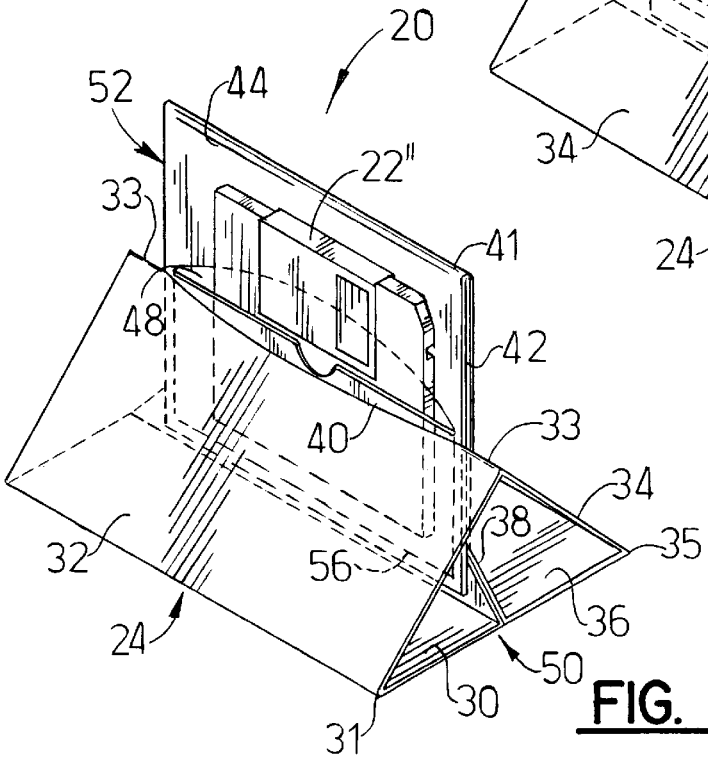
FIG. 12 is a side view in perspective and partially in phantom illustrating a display package having a computer diskette received therein.

In the embodiment shown in FIG. 12, once the glue has been applied to the first glue locations 58, a third body panel 60 is folded over into registration with the first body panel 42, along a common fold line 59, which is also creased. Thereafter, glue is placed in second glue locations 62 and the second body panel 44 is folded, along the common fold line 41, into registration with the first body panel 42.

Similarly, in the embodiments shown in FIGS. 7 and 8, once glue or other adhesive has been applied to the first glue locations 58, the third body panel 60 is folded over into registration with the second body panel 44 along a common fold line 59, which is also creased. Thereafter, glue or other adhesive is placed in second glue locations 62 and the glued second and third body panels 44 and 60 are folded into registration along the common fold line 41 between the first body panel 42 and the second body panel 44. The embodiments shown in FIGS. 7, 8, and 12 each disclose the use of three juxtaposed body panels 42, 44, and 60, to form two pockets 48, one located on each side of the display carrier 24 and wherein one of the body panels, for example third body panel 60, in FIGS. 7 and 8, is uninterrupted and acts as a back wall for each of the pockets. It is to be understood that one or more pockets 48 of varying shapes and sizes may be formed in the display carrier 24 without departing from the spirit of the present invention.

In each of the embodiments shown in FIGS. 9C, 7, 8, and 12, the plurality of body panels are secured together to form a body 52. The body 52 is then folded, along the common fold line 39, between the first body panel 42 and the first base panel 30, so that the body overlies the first base panel and the second base panel 32. In this position, the tip, i.e., the common fold line 41, of the body 52 extends partially into the elongate slot 40. The common fold line 39 is a cut/score line, such that there is a 50% cut which allows the body 52 to be easily folded during manufacture and allows the body to easily be moved as will be described below in greater detail.

The connecting panel 38 is then folded, along the common fold line 37, over the fourth base panel 36. This common fold line 37 is also a 50% cut/score line. Thereafter, glue or other adhesive is applied to third glue locations 64 on a lower portion of the second body panel 44. With respect to the embodiment of the blank 28 shown in FIG. 9C, it is only the second glue location, but for sake of consistency, it is being referred to as the third glue location 64. The third base panel 34 and the fourth base panel 36 and the lower portion of the second body panel 44 are moved into registration with each other and secured together by the third glue location 64. The manufacture of the display carrier 24 is then complete.

The common fold lines 31 and 35 are also 50% cut/score lines, whereas the common fold line 33 is a crease. As is readily understood by those skilled in the art to which the invention relates, each of the common fold lines may be creases, cut/score lines or interrupted cut lines (not shown) as desired. The use of 50% cut/score lines and the crease lines in the present invention were chosen to obtain the desired combination of strength and ease of manufacture and use. Applicants' acknowledge that several alternative combinations would be acceptable without departing from the spirit of the invention.

As shown in FIGS. 1 and 2, once the blank 28 has been folded and glued, the resultant display carrier 24 includes a base 50 and a body 52. The base 50 has a pair of opposed halves each formed of a pair of spaced apart upper panels formed from the second base panel 32 and the third base panel 34, and a pair of spaced apart lower panels formed from the first base panel 30 and the fourth base panel 36. The pair of spaced apart upper and lower panels are hingedly connected together along their outer edges which are formed by the common fold lines 31 and 35, respectively. The upper panels, i.e., the second base panel 32 and the third base panel 34 are hingedly connected together along their inner ends, i.e., their common fold line 33.

The upright body 52 is integrally connected to the base 50 along the common fold line 39 and extends upwardly therefrom through the elongate slot 40. The first body panel 42 and the second body panel 44 have an opposing relationship and define therebetween the pocket 48 into which the media item 22 is received.

As shown best in FIG. 9A, the cutaway portion 46 of the second body panel 44 is located in a medial portion thereof. The cutaway portion 46 has one edge thereof having a curved or elliptical shape and the opposite edge having a straight edge with a notch 54 centrally located therein. The shape of the cutaway portion 46 is to provide an easy access opening to the pocket for the media item 22. The notch 50 enhances this access to the cut away portion 46. It is to be understood that the shape of the cutaway and the inclusion or omission of the notch may vary depending on the particular application of the display carrier without departing from the spirit of the invention.

Below the cutaway portion 46 is an embossed area 56 which helps to partially define the pocket 48 and which has a shape generally corresponding to the media item 22 to be received within the pocket. In this instance, the embossed area 56 is arcuate so as to emulate the outer edge of a CD. In the embodiment shown in FIGS. 10A, 10B, 11A, and 11B, the embossed area 56 is generally rectangular or square to receive media items 22 such as booklets 22' or computer disks 22" which have square or rectangular lower edges. It is to be understood that the embossed area 56 can have almost any desired configuration. Furthermore, the pocket 48 may be in the form of a single band of paperboard (not shown) which is formed by cutting into the body panel at opposed side edges of the band to be formed and embossing opposed ends of the band to move it away from the remainder of the body panel. The advantage of such a pocket would be to display a substantial portion of the media item while retaining it within the display carrier 24.

As illustrated in FIGS. 1 through 6 and 9E, the display carrier 24, because of the hinged connections between each of the base panels 30 and 32, 32 and 34, 34 and 36, the hinged connection between the connecting panel 38 and the first body panel 42, and because of the existence of the elongate slot 40, is movable from a collapsed position (see FIG. 9E), to a first erected or open display position (See FIG. 1), and a second erected or compact display position (See FIG. 2). The elongate slot 40 has a generally elliptical configuration which allows a portion of the body 52 to project therethrough, which helps to guide the body 52 along the desired path i.e., through the elongate slot, to ensure a smooth transition of the display carrier 24 from the collapsed position to one of the display positions. In addition, the elliptical shape of the elongate slot 40 helps in loading a media item 22 into the display carrier 24 when in the collapsed position.

In the open display position shown in FIG. 1, the base 50 provides a support for the body 52 which extends upwardly therefrom through the elongate slot 40. The opposed upper panels, namely, the second base panel 32 and the third base panel 34 are considerably larger than the lower base panels, i.e., the first base panel 30 and the fourth base panel 36. In addition, the opposed upper panels are also angled toward each other in intersecting planes. The result of this configuration is that the upper and lower panels provide a triangular configuration to the base 50. Consequently, the upper panels 32 and 34 provide opposed billboards upon which indicia can be applied. This billboard effect is enhanced by having the upper panels be oriented at an angle of between 20° and 80°, preferably approaching 60° from the horizontal. It is to be understood that this angle may vary considerably depending on the desired application of the display carrier, without departing from the spirit of the invention. The indicia can be used for a wide variety of purposes such as advertising, instructional information, or visually stimulating artwork.

FIG. 2 illustrates the display package 20 in the compact display position which is well suited for displaying the media item 22 in a confined area such as on a retail shelf where music or computer CDs are frequently stacked on end in back to back relation. Because the display package 20 is within its protective wrap 26, the customer can quickly flip through a number of display packages to locate the desired media item, without causing any damage to either the display carrier 24 or the media item 22 received therein. In addition, it is also possible to place the media item 22, such as a colorful CD, on top of, rather than in, the pocket 48 of the display carrier 24 and encase both the display carrier and the media item in the protective wrap. This arrangement allows customers to view the entire media item.

When the display carrier 24 is in the compact display position shown in FIG. 2, the upright body 52 protrudes further above the elongated slot 40. In addition, the outer ends formed by common fold lines 31 and 35 are positioned closely adjacent each other so that the pair of upper panels 32 and 34 and the pair of lower panels 30 and 36 are in generally parallel alignment with each other. Consequently, as shown in FIG. 2, either one or both of the opposed pair of upper panels 32 and 34, and the lower panels 30 and 36 can both be frictionally fitted into a receiving slot XX, so as to be used as a shelf talker or the like. Alternatively, the display carrier can be hung by a string or the like (not shown) placed through aperture 66, from a ceiling or rafter of a retail outlet. Still another way of displaying the media item 22 in the display carrier 24 is to mount the display carrier, in the compact display position to a wall or the like by means of a fastener, such as a thumb tack (not shown).

The cooperation between the body 52 and the elongate slot 40 enables the display carrier 24 to remain in each of the display positions. At least one of the body panels has an elongate vertical edge portion 68 arranged in an outwardly and downwardly diverging relation to the elongate slot 40. In this embodiment shown in FIG. 9A, both body panels 42 and 44 have opposed vertical edge portions 68*a* and 68*b* which are arranged in an outwardly and downwardly diverging relation to each other so as to provide progressively increasing frictional engagement with opposite end portions of the elongate slot 40. The outwardly diverging relation of the opposed vertical edge portions 68*a* and 68*b* may be seen by comparing the length $1^1$ of line A—A to the length $1^2$ of line B—B. The length $1^1$ is less than the length $1^2$. As a result, as the display carrier 24 moves from the collapsed position shown in FIGS. 5 and 10A, to the open display position shown in FIGS. 1, 11A, 11B, and 12, by moving in the manner shown in phantom in FIG. 3, the opposed vertical edge portions 68*a* and 68*b* increasingly frictionally engage the adjacent edge portions of the elongate slot 40. In addition, the triangular shape of the base 50 assists in maintaining the display carrier 24 in the open display position.

Figure 4:
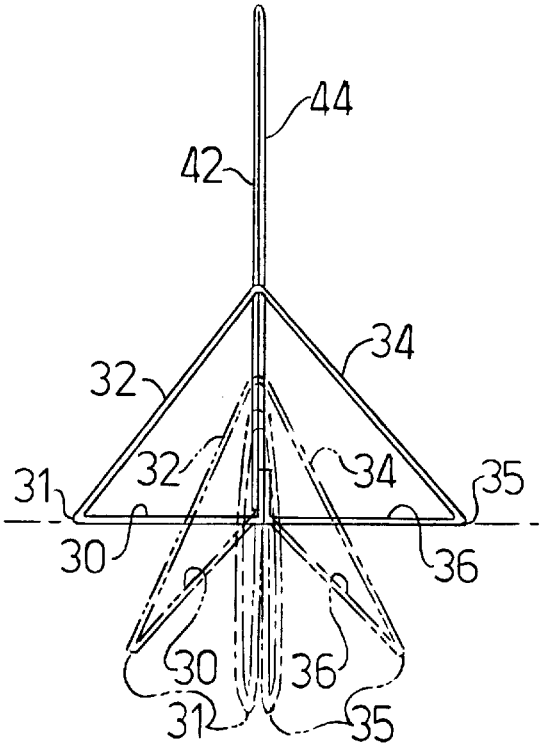
FIG. 4 is an end view similar to that shown in FIG. 1, illustrating, in phantom, the movement of the display package from the open display position to the compact display position.

As the display carrier 24 moves in the manner shown in phantom in FIG. 4, i.e., from the open display position to the compact display position shown in FIGS. 2 and 6, the frictional engagement between the opposed edge portions 68*a* and 68*b* and the elongate slot 40 increases. This increased frictional engagement helps to maintain the display carrier 24 in the compact display position. It is to be understood that the outwardly and downwardly diverging opposed edge portions may be augmented by periodic notches, lances, or steps which will allow the display carrier 24 to be positioned in a multiple of predetermined intervening positions between the collapsed position and the compact display position without departing from the spirit of the present invention. One example illustrative would be a straddle display position between the open display position and the compact display position which enables the display package straddle a rounded or angled counter top or partition.

Figure 14:
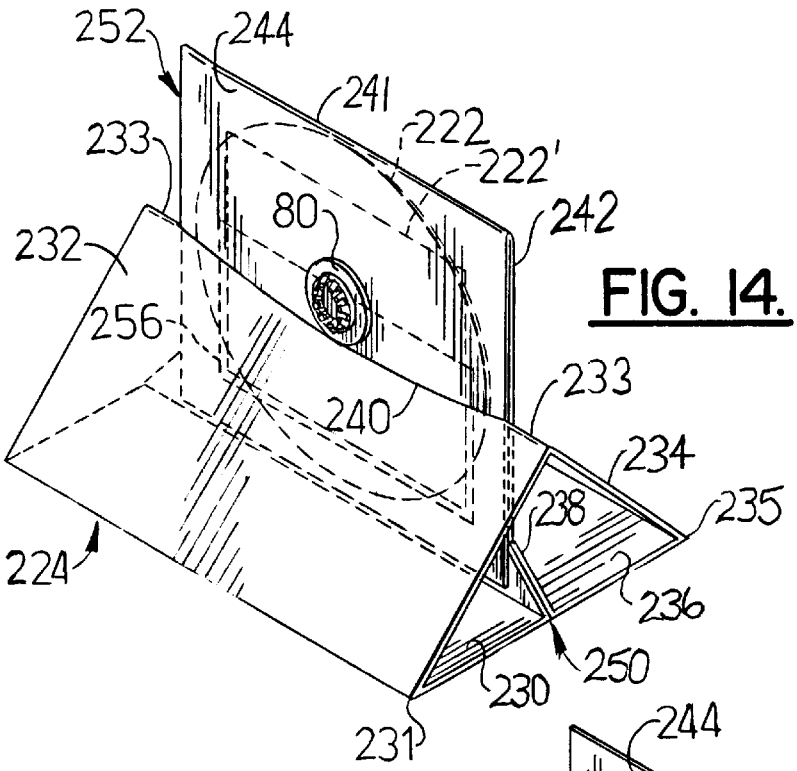
FIG. 14 is a side view in perspective showing an alternative embodiment of the present invention.

An alternative embodiment of the invention is shown in FIG. 14 wherein a pocket is provided on one side of the display carrier 224 for receiving a media item 222' such as a booklet and rather than a pocket on the opposed side of the body 252, a center retainer 80 may be mounted, which is adapted to receive and selectively retain a media item 222, such as a CD. The center retainer 80 is mounted to the body panel 244 by an adhesive or similar means. As shown, the center retainer 80 has a frusto-conical configuration which helps to position a CD thereon and helps to allow the leading edge of the elongate slot 240 travel thereover i.e., ramp over the center retainer as the display carrier 224 moves between the collapsed position and one of the display positions.

Figure 15:
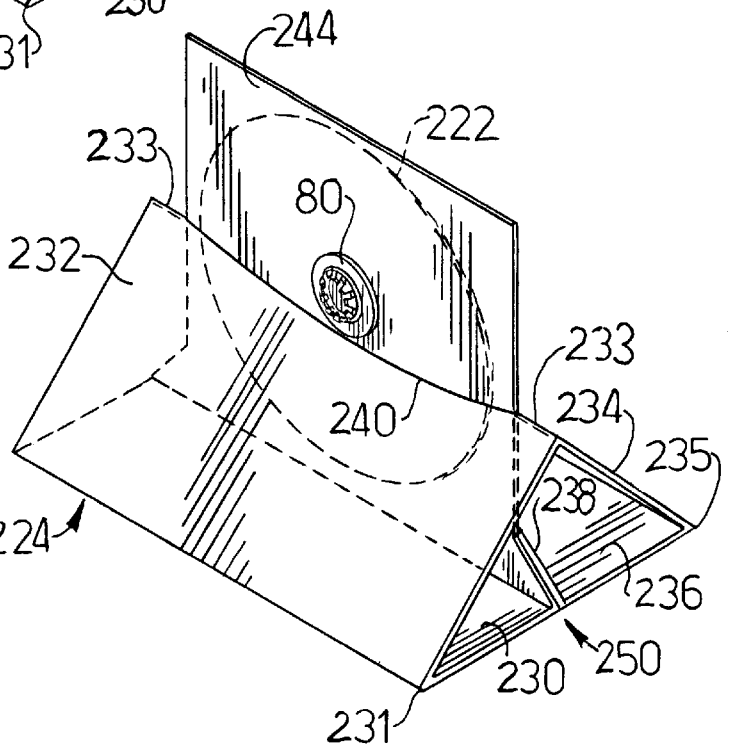
FIG. 15 is a side view in perspective showing still another embodiment of the display package of the present invention.

As shown in another embodiment of the invention in FIG. 15, it is possible to attach the center retainer 80 to a single body panel 244 without having a pocket 48 formed on the opposed side. In such a configuration, the body 252 comprises a single body panel 244 which is hingedly connected to the first base panel 230.

Figure 16:
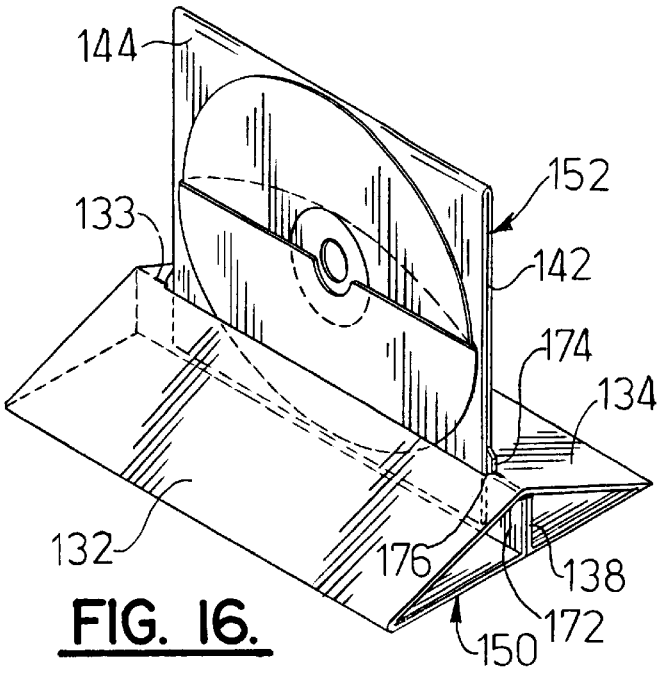
FIG. 16 is a side view in perspective and partially in phantom illustrating an alternative embodiment of the display package in accordance with the present invention.
Figure 17:
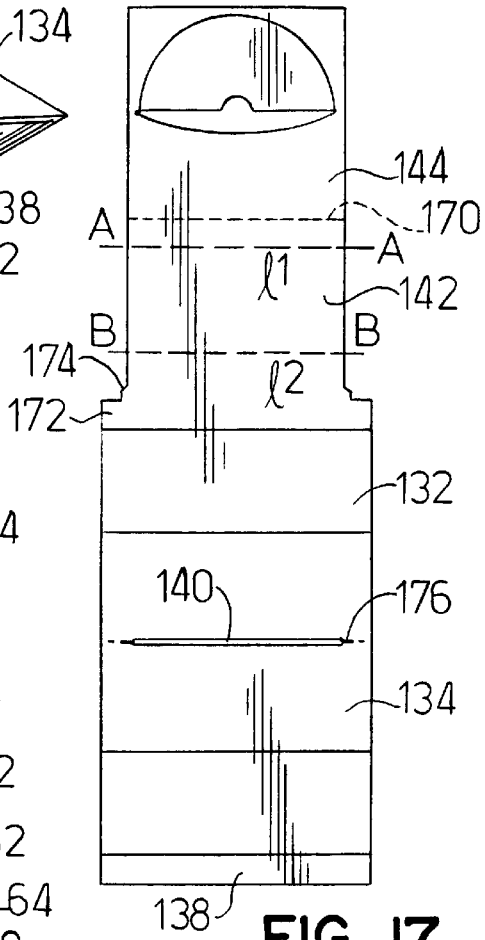
FIG. 17 is a top plan view of a blank used to form the display carrier shown in FIG. 14.
Figure 13:
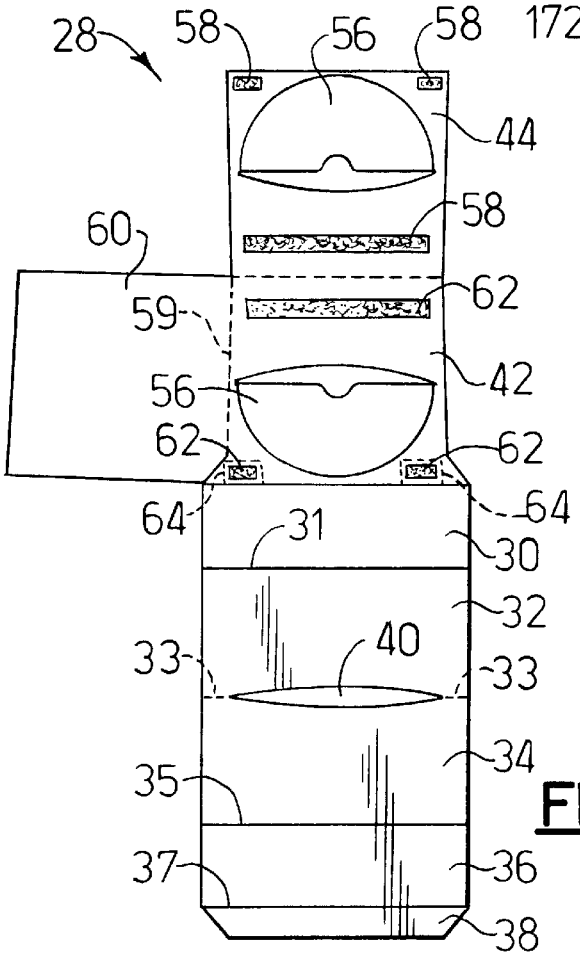
FIG. 13 is a top plan view of an alternative embodiment of a blank used to form a display carrier having two opposed pockets.

In still another alternative embodiment of the present invention is shown in FIGS. 16 and 17. In this embodiment, the first and second body panels 142 and 144 which form the body 152 do not have opposed side edges 168*a* and 168*b* which are outwardly and downwardly diverging as in the previously described embodiments. As may be seen, in the embodiment shown in FIGS. 16 and 17, the length $1^1$ of line A—A and the length $1^2$ of line B—B are the same. As a result, the body 152 has a generally rectangular tongue portion 170 which is sized to fit within a generally rectangularly shaped elongate slot 140, and a base portion 172 which forms shoulders located on either side of the tongue portion. Opposed tabs 174 are located on each side of the tongue portion 170 between the tongue portion and the base portion 172. As best illustrated in FIG. 16, the tabs 174 are shaped so as to engage slits 176 located at opposed ends of the slot 140. The slits 176 have a smaller width than the slot 140 to pinch and retain the tabs 174 therein when the display carrier 124 is in the erected position shown.

The blank shown in FIG. 17 contains a connecting panel, in this embodiment referred to as an end panel 138, which has the same axial width as the base portion 172 of the body 152 so as to form a common shoulder or support abutment. In the erected position, the fold line 133 between the opposed upper panels 132 and 134, rests on or abuts the support abutment formed by the combination of the base portion 172 and the end panel 138. As a result of the tabs 174 being retained within the slits 176 and the fold line 133 of the upper panels 132 and 134 resting on the support abutment, the lower panels 130 and 136 of the base 150 can not be moved passed 90° relative to the body 152. Consequently, this embodiment of the display carrier 124 can only be moved between the collapsed position and the erected position. The display carrier 124 can not be moved to the compact display position described in detail above with reference to the first embodiment. In addition, the triangular configuration of the base 150 and correspondingly the angle of the upper panels 132 and 134 is considerably different than in the previously described embodiments.

Figure 18:
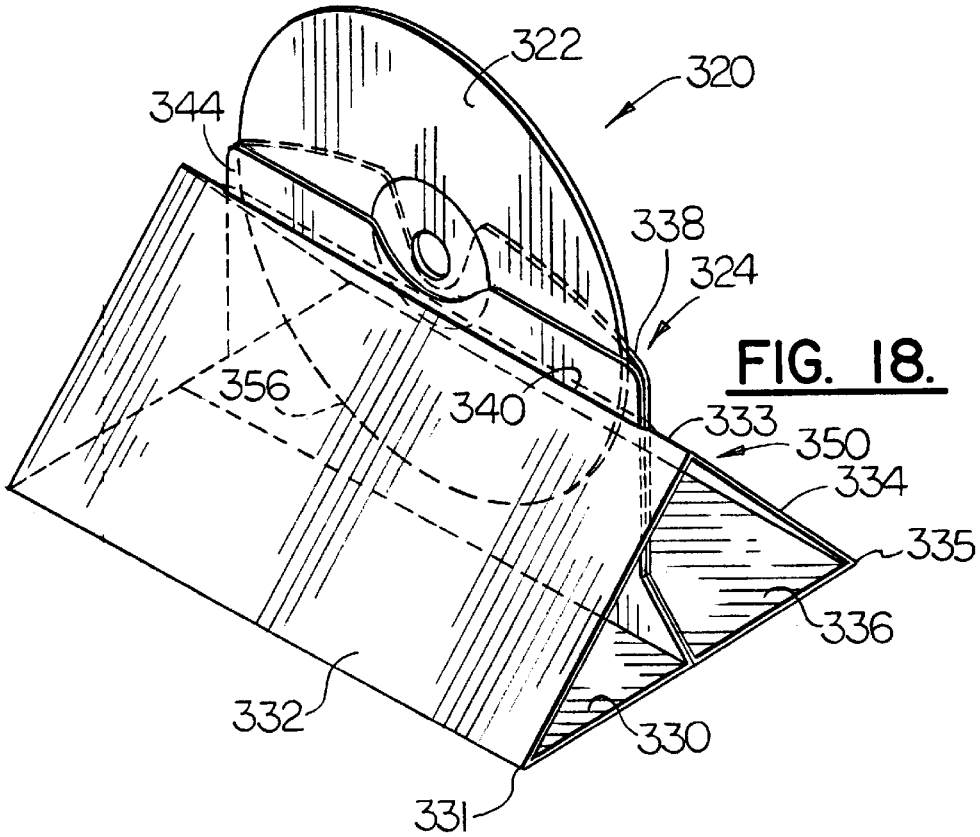
FIG. 18 is a perspective view of another embodiment of the display carrier of the present invention in an open display position.
Figure 19:
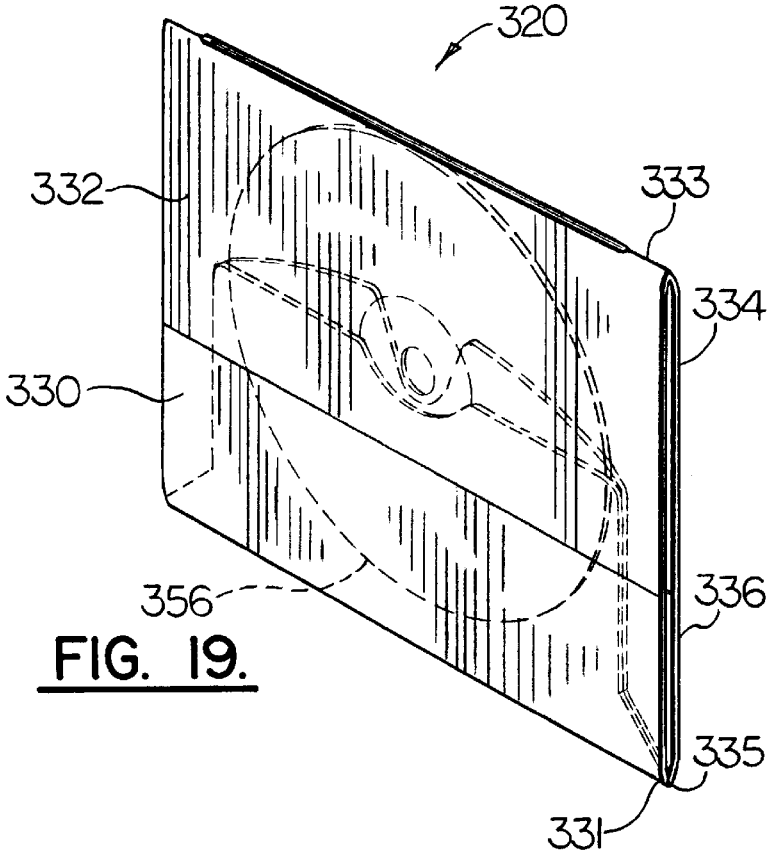
FIG. 19 is a view of the embodiment of the display carrier shown in FIG. 18 in a compact display position.
Figure 22:
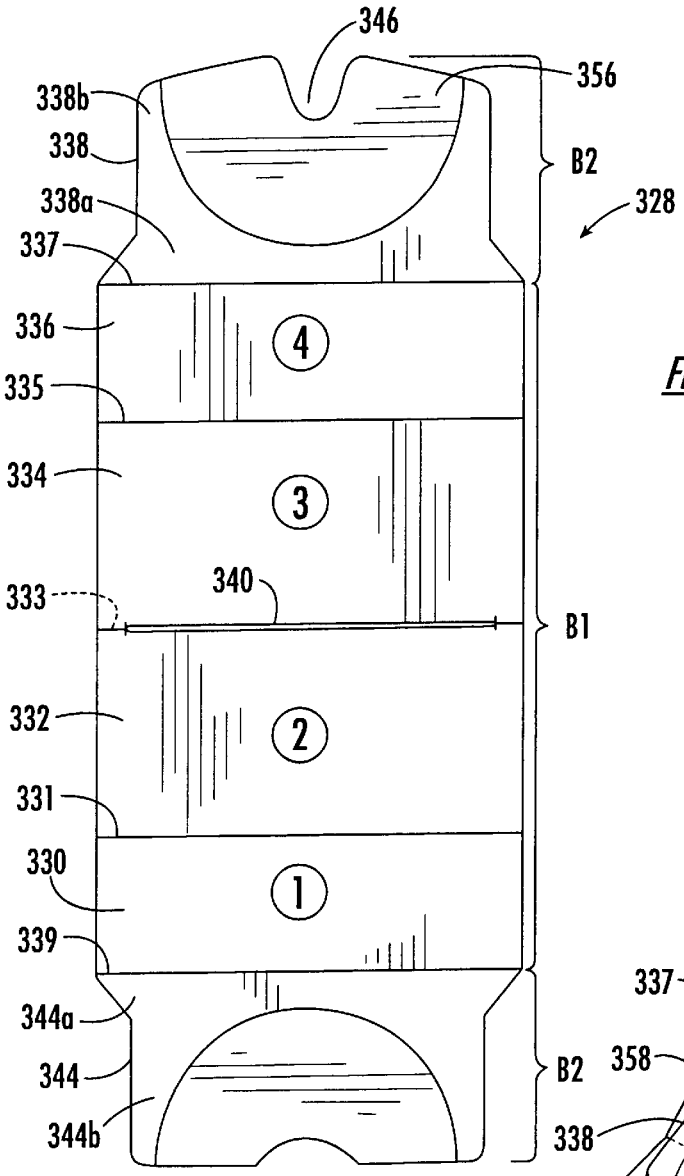
FIG. 22 is a top plan view of a blank used in forming the display carrier of FIG. 18.

Turning now to FIGS. 18 and 19, there is shown another embodiment of the display package 320 of the present invention having a media item 322, retained therein. The display package 320 includes a display carrier body 324, which is adapted to receive the media item 322. As best shown in FIGS. 18–19 and 22, the display package 320 of the present embodiment is formed from a blank, generally indicated as 328, which is made from paperboard. It is to be understood that different quality, color, or gauge of paperboard or alternative materials such as plastic or a light metal alloy, or a combination thereof, may be used to make the display carrier within the spirit of the invention, so long as the material used is capable of being cut and folded while retaining the desired shape of the display carrier. It is also to be understood that a coating or other surface treatment need not be used at all or may only be on one side of the paperboard without departing from the spirit of the invention.

The blank has a base forming portion $B^1$ substantially identical to the base portion of FIG. 1, and two body forming portions $B^2$. The base forming portion $B^1$ includes a plurality of serially arranged panels and has a generally rectangular configuration. A first base panel 330 is integrally formed and hingedly connected, along a common fold line 331, to a second base panel 332. The second base panel 332 is in turn integrally formed with and hingedly connected, along a common fold line 333, to a third base panel 334. The third base panel 334 and a fourth base panel 336 are integrally formed with and hingedly connected, along a common fold line 335, to each other. An elongate slot or slit 340 is defined in a central portion of fold line 333 between the second base panel 332 and the third base panel 334.

The body forming portions $B^2$ include a first body panel 338 which is integrally formed with and hingedly connected along a common fold line 337, to the fourth base panel 336. The inner portion 338*a* of the first body panel 338 forms an outer lengthwise extremity of the base forming portion $B^1$ of the blank 328. The upper portion 338*b* of the first body panel 338 is narrower than the width of the base forming panels and the width of slot 340 but wide enough to accommodate a media item 322. The upper portion 338*b* is of such height that the media item may protrude above its top edge when the display package is formed and forms the back wall of the body forming section. The top edges of the first panel may contain a cutaway portion 346 for easy access to the media item.

Figure 23:
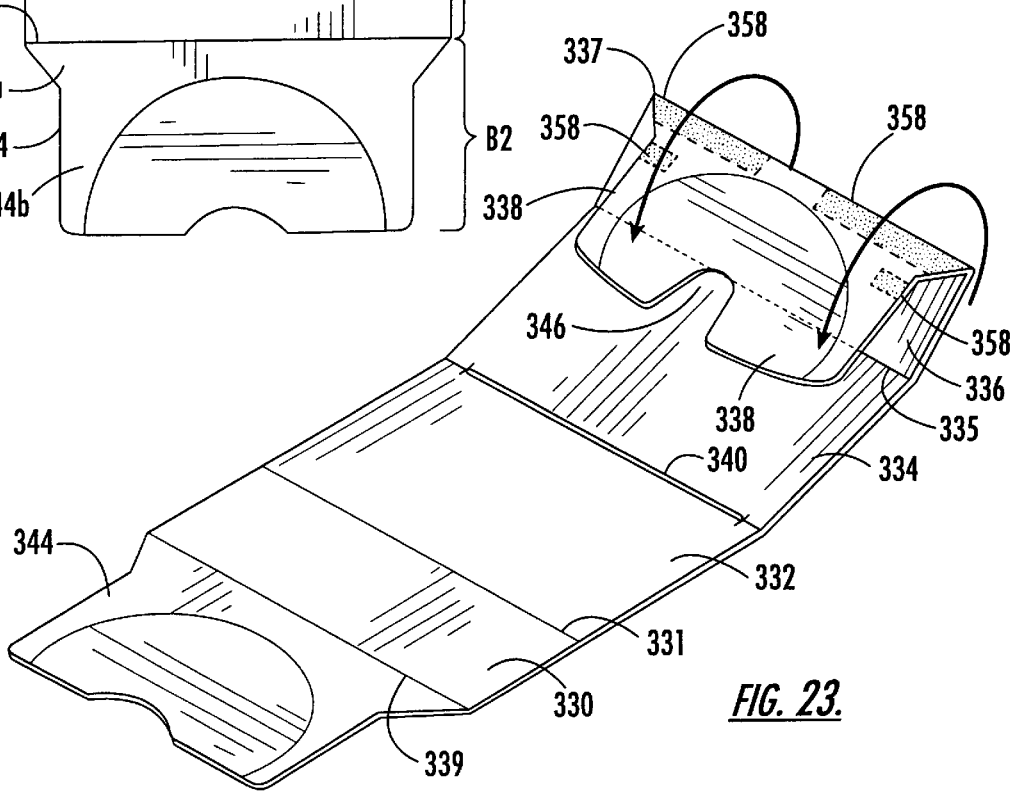
FIG. 23 is a perspective view of the blank shown in FIG. 22 illustrating gluing locations and the first and second folds to be made in forming the display carrier.

The body forming portion also includes a second body panel 344 which forms the front wall of the body forming section. The second body panel 344 is integrally formed with and hingedly connected along a common fold line 339, to first base panel 330. The inner portion 344*a* of the second body panel 344 forms an outer lengthwise extremity of the base forming portion $B^1$ of the blank 328. The upper portion 344*b* of second body panel 344 is narrower than the width of the base forming panels and the width of slot 340 but wide enough to accommodate a media item. In a preferred embodiment, the width of first body panel 338 and second body panel 344 are the same. In some uses, it is preferred that the second body panel 344 is shorter than the first body panel. As shown in FIG. 23, the second and third base panels 332 and 334 are considerably longer than the first and fourth base panels 330 and 336. The benefit of such a configuration of the base forming portion $B^1$ is described in greater detail below.

Figure 20:
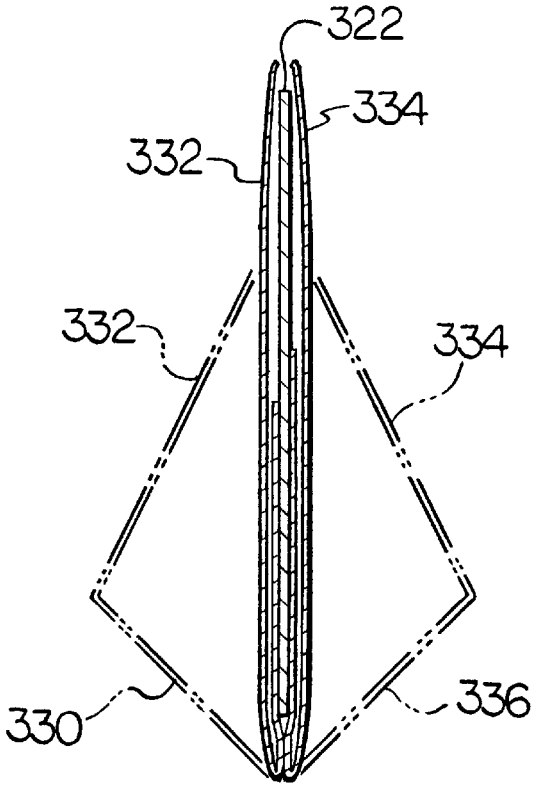
FIG. 20 is an end view of the display carrier shown in FIG. 18, illustrating in phantom, the collapsed and intermediate positions of the display carrier.
Figure 24:
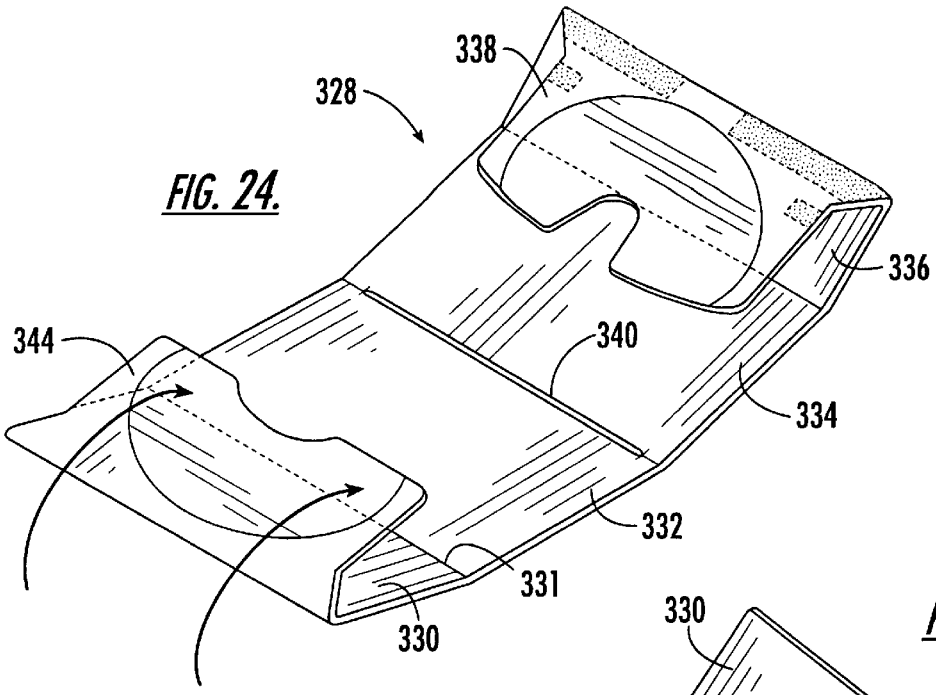
FIG. 24 is a perspective view of the blank shown in FIG. 23 illustrating additional folds to be made in forming the display carrier.
Figure 25:
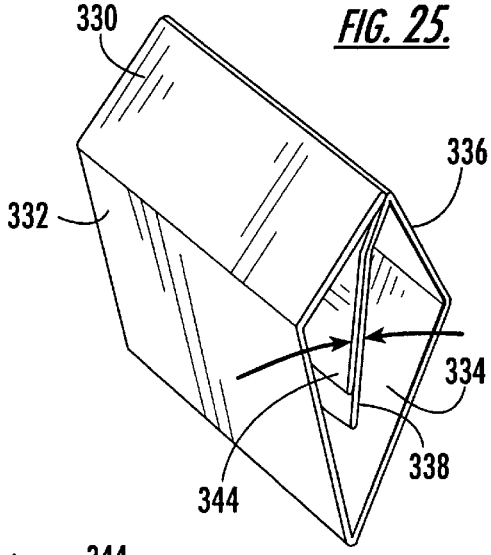
FIG. 25 is a perspective view of the blank shown in FIG. 22 illustrating the final fold to be made in forming the display carrier.
Figure 26:
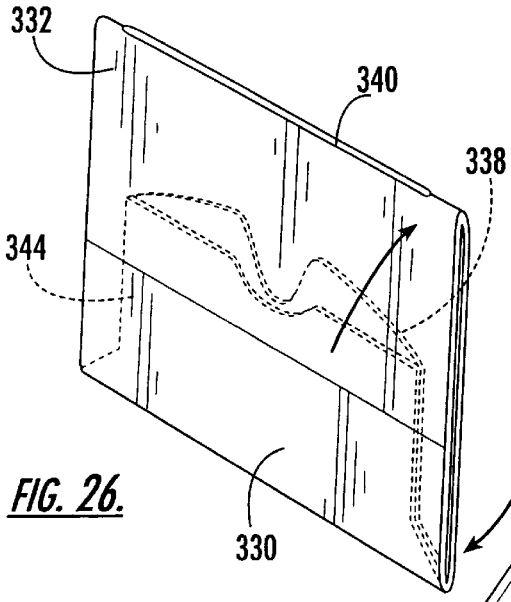
FIG. 26 is a perspective view, partially in phantom, of the display carrier illustrating the display carrier in a closed position.
Figure 27:
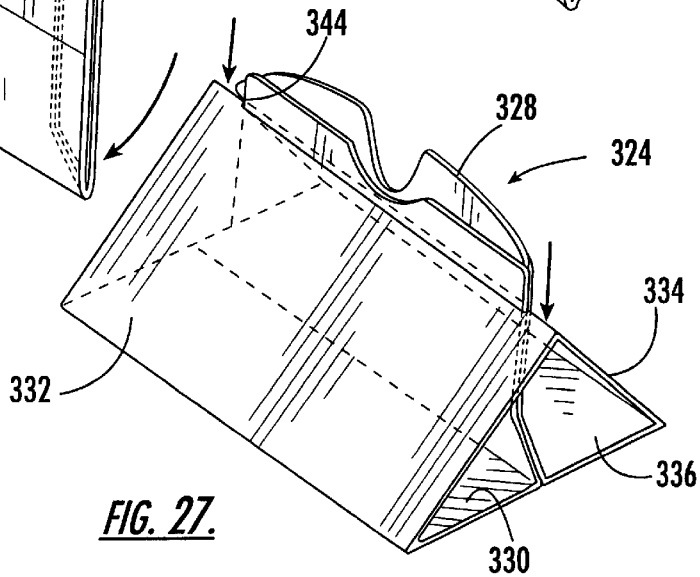
FIG. 27 is a perspective view, partially in phantom, of the display carrier of the embodiment of the present invention shown in FIG. 18 illustrating how the display carrier moves to one of the display positions.

By comparing FIGS. 23–26, it may be seen how the blank 328 is folded and glued to form the display package 320. As shown in FIG. 23, glue or other adhesive is applied to glue locations 358 on the first body panel 338. First body panel 338 is folded along common fold line 337 which is creased to ease folding. As shown in FIG. 24, the procedure is then followed at the other end of blank 328 wherein second body panel 344 is folded along creased fold line 339. As shown in FIG. 25, first body panel 338 and second body panel 344 are joined at the adhesive spots 358 to form the completed display package 320 folded along fold line 333, shown in FIG. 26 in the closed position. The display package may be moved to the open or display position as shown by the partially open display package shown in FIG. 20 and the open display package shown in FIG. 21 and FIG. 27. The third base panel 334 and the fourth base panel 336 and the lower portions of the body panels are moved into registration with each other and secured together by the glue location 358. The manufacture of the display carrier 324 is then complete.

As shown best in FIG. 22, the cutaway portion 346 of the second body panel 338 is located in a medial portion thereof. The cutaway portion 346 has a curved or elliptical shape. The shape of the cutaway portion 346 is to provide an easy access opening to the pocket for the media item 322. It is to be understood that the shape of the cutaway and the inclusion or omission of the notch may vary depending on the particular application of the display carrier without departing from the spirit of the invention.

Below the cutaway portion 346 may be an embossed area 356 which helps to partially define the pocket and which has a shape generally corresponding to the media item 322 to be received within the pocket. In this instance, the embossed area 356 is arcuate so as to emulate the outer edge of a CD.

Figure 21:
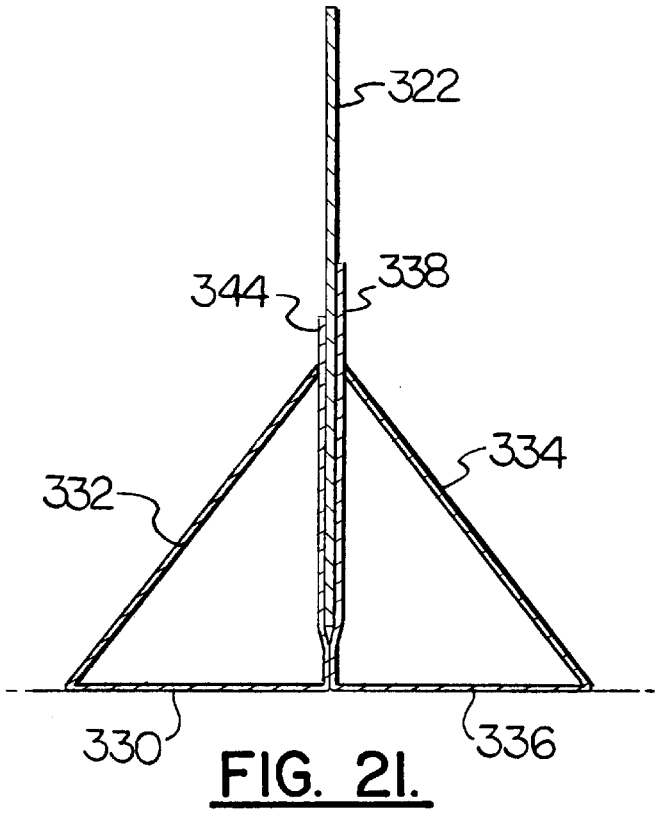
FIG. 21 is an end view of the display carrier shown in FIG. 18 illustrating the display carrier in the open display position.

As illustrated in FIGS. 18–27, the display package 320, because of the hinged connections between each of the base panels 330 and 332, 332 and 334, 334 and 336, the hinged connection between the first body panel 338 and the second body panel 344, and because of the existence of the elongate slot 340, is movable from a closed or collapsed position (see FIGS. 19 and 20), to an erect or open display position (See FIG. 21). The elongate slot 340 may have a generally elliptical configuration which allows a portion of the body 324 to project therethrough, which helps to guide the body 324 along the desired path i.e., through the elongate slot, to ensure a smooth transition of the display package 320 from the collapsed position to the open position. In addition, the elliptical shape of the elongate slot 340 helps in loading a media item 322 into the display package 320 when in the collapsed position.

In the open display position shown in FIG. 18, the base 350 provides a support for the body 324 which extends upwardly therefrom through the elongate slot 340. The opposed upper panels, namely, the second base panel 332 and the third base panel 334 are considerably larger than the lower base panels, i.e., the first base panel 330 and the fourth base panel 336. In addition, the opposed upper panels are also angled toward each other in intersecting planes. The result of this configuration is that the upper and lower panels provide a triangular configuration to the base 350.

When the display package 320 is in the open position, the inner portion 338*a* of first body panel 338 and the inner portion 344*a* of second body panel 344 are aligned with each other and are joined together. A shown, the outer edges of the inner portions 338*a* and 344*a* extend outwardly directing from the sides of upper portions 338*b* and 344*b* to end fold lines 337 and 339, respectively, forming an angle. Optionally, the outer edges of the inner portions 338*a* and 344*a* may extend directly toward fold lines 337 and 339, respectively, without any outward extension.

Figure 28:
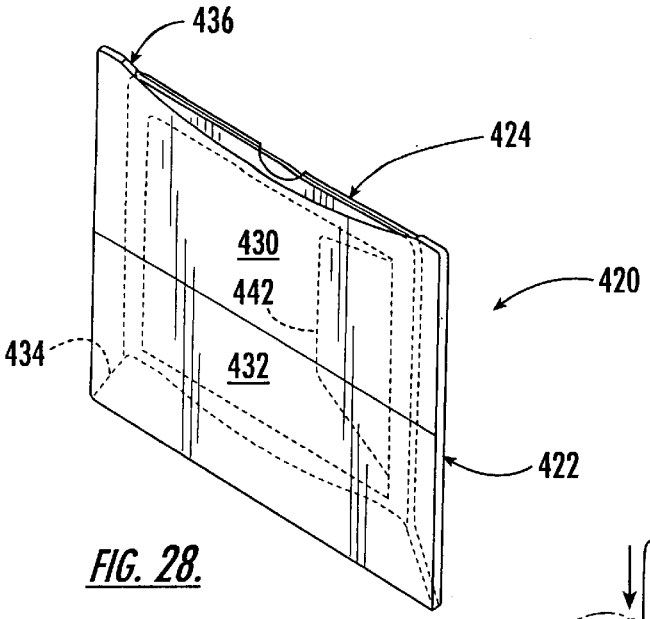
FIG. 28 is a perspective view, partially in phantom, of a display carrier for displaying a graphic media item in accordance with still another embodiment of the invention, showing the display carrier in a closed position.
Figure 29:
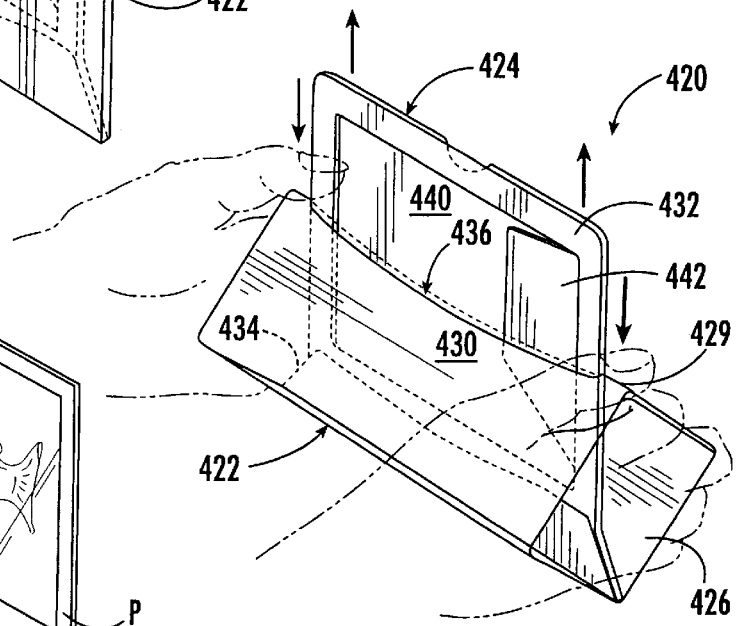
FIG. 29 is a perspective view showing the display carrier of FIG. 28 being opened.
Figure 30:
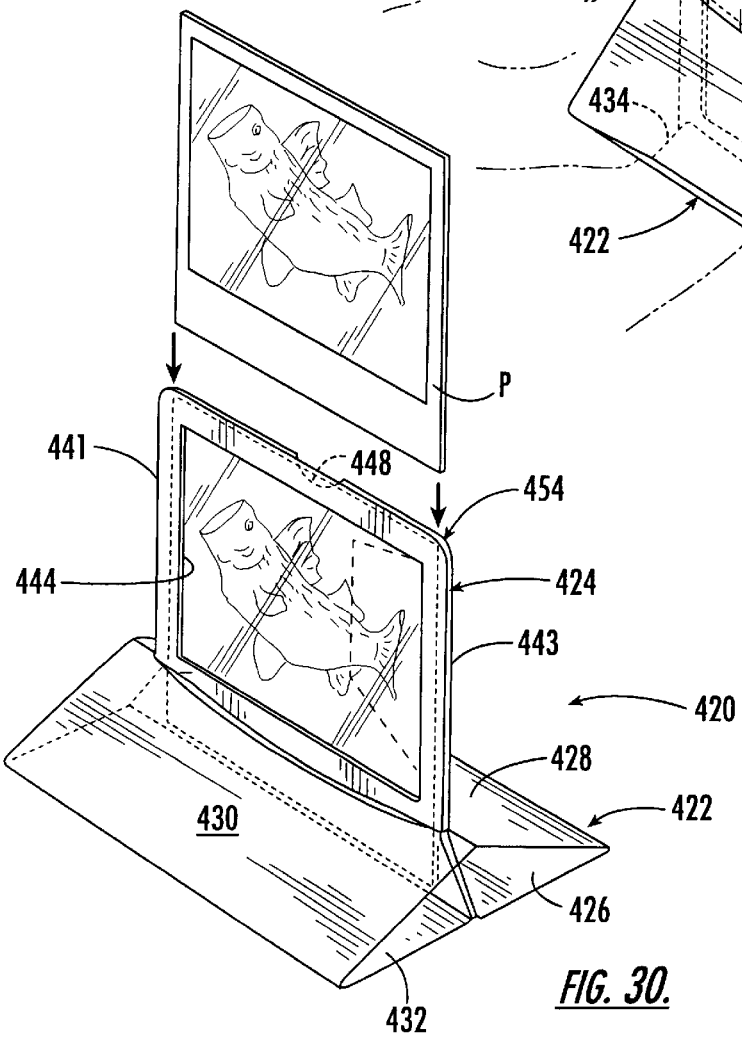
FIG. 30 is a perspective view of the display carrier of FIG. 28 shown in a fully open position and showing a graphic media item being inserted into the pocket of the body portion.

FIGS. 28–34 illustrate yet another embodiment of a display carrier 420 and a blank 421 for forming the carrier in accordance with the invention, which is suitable for displaying a graphic media item such as a photograph, collectible card, or the like. The display carrier 420 is formed of a base portion 422 and a body portion 424. The base portion 422 is formed by a plurality of serially connected panels including a lower panel 426 and an upper panel 428 which are hingedly connected to each other along a common fold line 427 which defines the outer ends of the panels 426, 428. The lower and upper panels 426, 428 define one-half of the base portion 422. The other half of the base portion 422 is formed by a second upper panel 430 and a second lower panel 432 which are hingedly connected along a common fold line 431 which defines the outer ends of the upper and lower panels 430, 432. The two upper panels 428 and 430 are connected to each other along a common fold line 429. A connecting panel 434 is hingedly connected to the lower panel 432 along a common fold line 433. Central portions of the upper panels 428, 430 are spaced apart from each other at the fold line 429 to define an elongate slot 436 therebetween through which the body portion 424 extends in the assembled condition as shown in FIGS. 28–30.

The body portion 424 is formed by a first body panel 438 which is hingedly connected along a common fold line 439 to the lower panel 426, and a second body panel 440 which is hingedly connected along a common fold line 441 to the first body panel 438. The fold line 441 defines a side edge of the first body panel 438 which extends in a vertical direction when the display carrier 420 is in the display position as shown in FIG. 30. An attachment flap 442 is hingedly connected along a common fold line 443 to the first body panel 438. The fold line 443 defines an opposite side edge of the first body panel 438 which extends in a vertical direction when the carrier is in the display position.

The first body panel 438 includes a rectangular window 444 therein whose sides are preferably parallel to the fold lines 439, 441, 443, and the top edge 445 of the first body panel. Thus, the first body panel 438 forms a generally rectangular frame surrounding the window 444. The second body panel 440 is formed such that when folded over upon the first body panel 438, the top edge 447 of the second body panel is parallel and aligned with the top edge 445 of the first body panel. A thumb notch 448 is formed at the top edge 447 of the second body panel.

Figure 32:
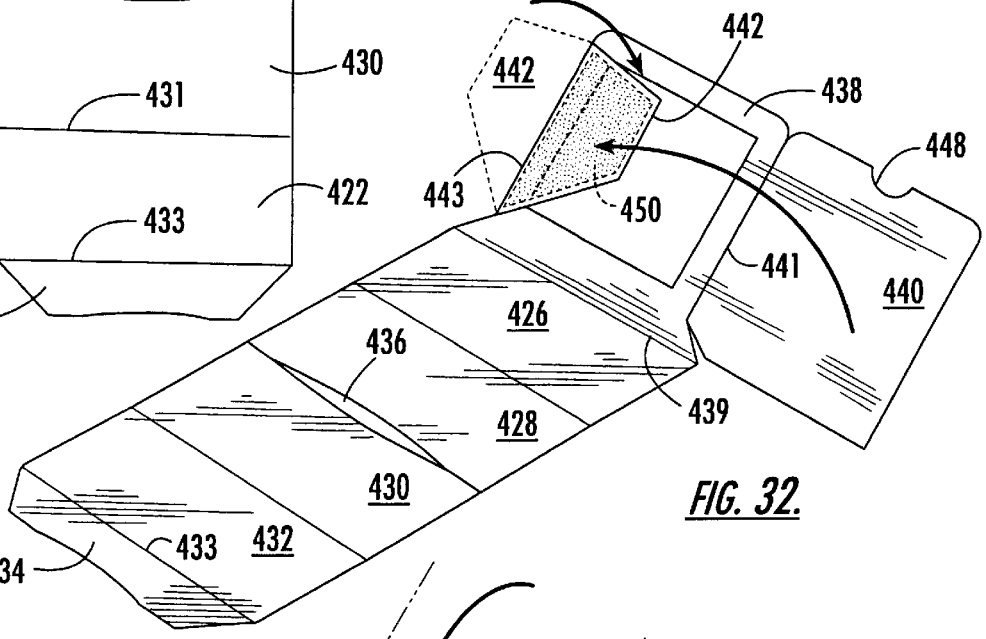
FIG. 32 is a perspective view of the blank of FIG. 31, showing the folding of the body panels and the gluing and folding of the attachment flap.
Figure 33:
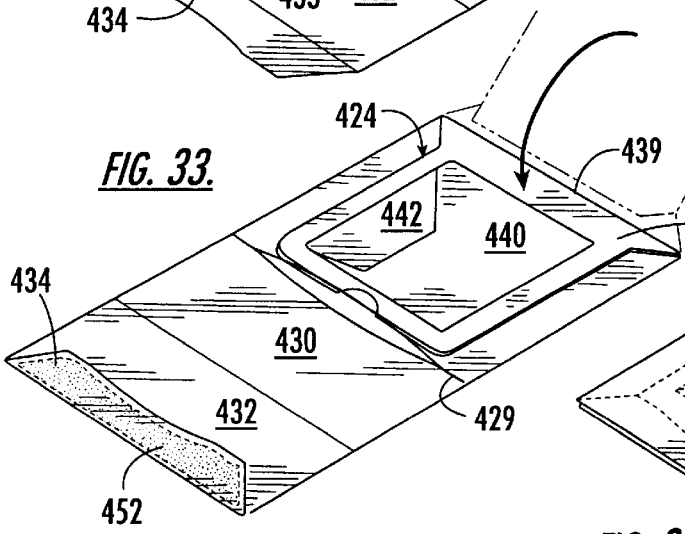
FIG. 33 is a perspective view of the blank of FIG. 31, showing the folding of the assembled body portion onto the base panels and showing the folding of and application of adhesive to the connecting panel.
Figure 34:
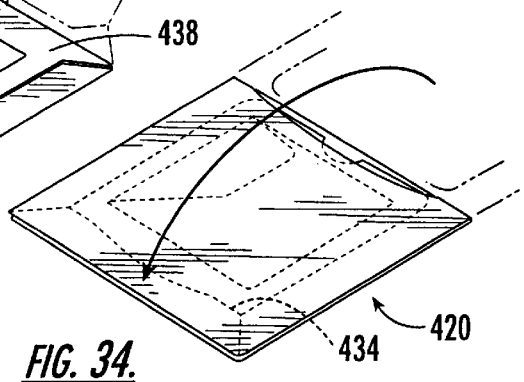
FIG. 34 is a perspective view of the blank of FIG. 31, showing the folding of the base panels to glue the connecting flap to the body portion.

FIGS. 32–34 depict the assembly of the display carrier 420 from the blank 421. As shown in FIG. 32, the body portion 424 is assembled by folding the attachment flap 442 about the fold line 443 so that the flap generally overlies the first body panel 438 in parallel relation thereto. Adhesive 450 is applied to a surface of the flap 442 facing away from the first body panel 438. The second body panel 440 is folded about the fold line 441 onto the attachment flap in parallel relation thereto and is secured to the flap by the adhesive 450.

With reference to FIG. 33, the assembled body portion 424 is folded about the fold line 439 so that the body portion overlies the base panels 426 and 428 in parallel relation thereto. The connecting panel 434 is folded about the fold line 433 so that it overlies the lower panel 432 in parallel relation thereto, and adhesive 452 is applied to the upward-facing surface of the connecting panel 434 which faces away from the lower panel 432. As shown in FIG. 34, the body portion 424 and the upper and lower base panels 426, 428 are folded as a unit about the fold line 429 so as to overlie the upper and lower base panels 430, 432 and the folded connecting panel 434 in parallel relation thereto. The connecting panel 434 is secured to the first body panel 438 by the adhesive 452 to complete the assembly of the display package 420.

As shown in FIG. 29, the display package 420 is converted to the display position of FIG. 30 by pushing downward on the fold line 429 on either side of the elongate slot 436 so as to cause the body portion 424 to extend upward through the slot 436. The base portion 422 is moved relatively downward in relation to the body portion 424 until the two lower panels 426 and 432 are coplanar so that they can be rested on a support surface. The base portion 422 thus forms a triangular structure.

Figure 31:
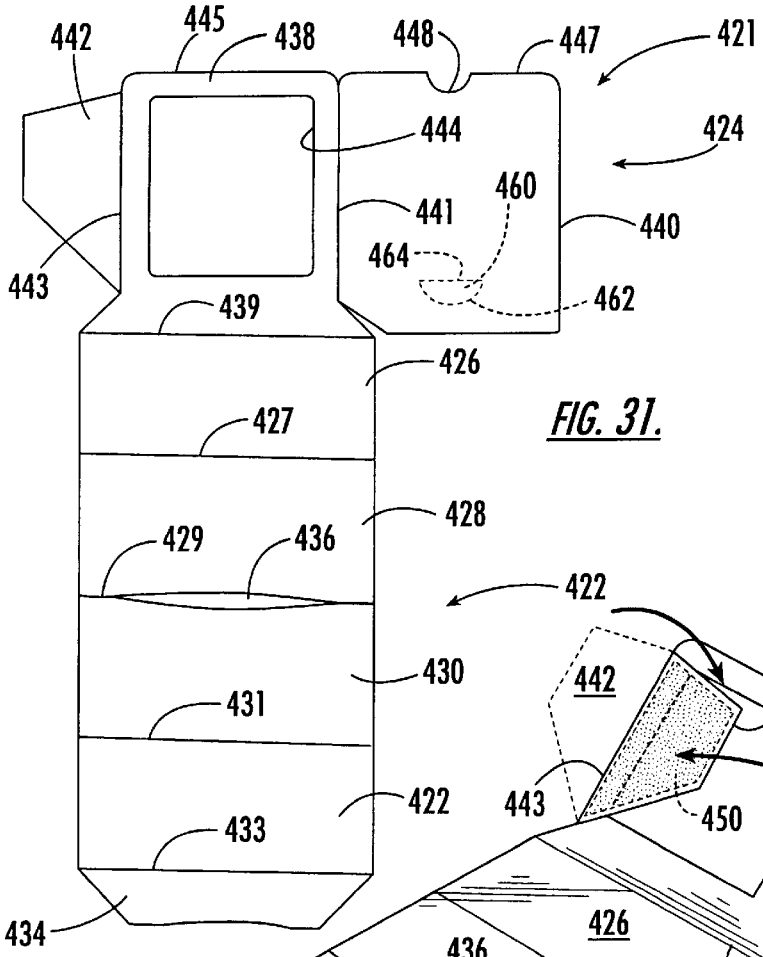
FIG. 31 is a top elevation of a blank for forming a display carrier such as that shown in FIG. 28.

As indicated by dashed lines in FIG. 31, a locking tab 460 may optionally be provided for holding the display package in the display position. The locking tab 460 is formed by making an arcuate slit 462 in the body panel 440 so that the tab 460 can be bent out of the plane of the body panel 440 along a fold line 464 that extends between the opposite ends of the arcuate slit 462. When the display package is converted to the display position as shown in FIG. 30, the locking tab 460 engages the edge of the base panel 428 adjacent the slot 436 and thereby tends to prevent the body portion 424 from withdrawing into the base portion 422.

The opposing top edges 445 and 447 of the body panels 438 and 440, respectively, define a slot 454 therebetween through which a graphic media item such as a photograph P is inserted. The item P is inserted between the first body panel 438 and the attachment flap 442. The thumb notch 448 in the top edge of the second body panel 440 facilitates grasping a top edge of the item P so that the item can be removed.

The upper and lower panels 426 and 428 forming one of the halves of the base portion 422 preferably have a combined length (measured in the longitudinal direction perpendicular to the slot 436) which is equal to the combined length of the upper and lower panels 432 and 430 forming the other half of the base portion, and this combined length preferably is at least as great as the length of the body portion 424. Accordingly, as shown in FIG. 28, when the display package 420 is in the closed position, the body portion 424 is entirely enclosed within the base portion 422.

Additionally, it is preferable to form the upper panels 428 and 430 so that each of them has a length not substantially exceeding half the length of the body portion 424. This ensures that the entire window 444 extends above the slot 436 in the display position, as shown in FIG. 30.

It will be recognized that other configurations are possible for forming a graphic media item display package. For instance, as an alternative to the display package 420 described above, a display package can be formed from a symmetrical blank of the type shown in FIG. 22, but having one of the endmost panels formed with a window and the other endmost panel formed with or without a window. One of the endmost panels may have attachment flaps hingedly connected along its opposite side edges for attaching the two endmost panels together when the blank is assembled to form the display package. Other configurations are also possible.

Many modifications and other embodiments of the invention will come to mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

What is claimed is:

1. A display carrier for a graphic media item, comprising:

a base having opposing halves each formed of an upper panel and a lower panel hingedly connected together along outer ends of the panels, the upper panels also being hingedly connected together along inner ends thereof, central portions of the inner ends of the upper panels being spaced apart from each other to define an elongate slot therebetween; and an upright body portion comprising a first body panel hingedly connected along a first edge thereof to an inner edge of a first one of the lower panels, and a second body panel hingedly connected to the first body panel, and further including an attachment flap hingedly connected to the first body panel, the second body panel overlying the first body panel and being secured to the attachment flap to define a pocket adapted for reception therein of a graphic media item, the body panels extending upwardly through the slot and one of the first and second body panels having a window therein for viewing of the graphic media item.

2. The display carrier of claim 1, wherein the upper and lower panel of each of the halves of the base have a combined length which is substantially the same as that of the body portion such that the display carrier is foldable into a flat orientation with the two halves of the base substantially entirely enclosing the body portion therebetween.

3. The display carrier of claim 2, wherein the upper panels have equal lengths not substantially greater than about one-half a length of the body portion such that at least about three-quarters of the length of the body portion extends above the elongate slot, whereby the base affords an unobstructed view of the graphic media item.

4. The display carrier of claim 1, wherein the second body panel is hingedly connected to the first body panel along a vertically extending side edge of the first body panel such that a slot is defined between top edges of the first and second body panels for insertion of a graphic media item therethrough.

5. The display carrier of claim 1, further comprising a connecting panel hingedly connected to an inner edge of a second one of the lower panels, the connecting panel being secured to one of the first and second body panels in parallel relation thereto.

6. The display carrier of claim 1, wherein the attachment flap is hingedly connected to the first body panel along an edge thereof opposite the hinged connection of the first and second body panels, the attachment flap being secured to the second body panel in parallel relation thereto.

7. The display carrier of claim 6, wherein the second body panel is connected to the first body panel along a vertically extending second edge of the first body panel, and the attachment flap is hingedly connected to the first body panel along a third edge thereof opposite the second edge thereof and is secured to the second body panel.

8. The display carrier of claim 1, wherein the window is formed in the first body.

9. The display carrier of claim 1, further comprising a locking tab formed on the second body panel, the locking tab being bendable relative to the second body panel so as to project outwardly therefrom and engage an upper edge of one of the upper panels of the base adjacent the elongate slot, the locking tab thereby tending to prevent the body portion from being withdrawn through the slot into the base.

10. A blank formed from a unitary sheet material for forming a display carrier for a graphic media item, and comprising:

a base-forming portion defined by a plurality of serially connected panels including first and second base panels hingedly connected to each other along a common fold line and third and fourth base panels hingedly connected to each other along a common fold line, the second and third base panels being hingedly connected to each other along a common fold line, and an elongate slot being formed between the second and third base panels; and a body-forming portion comprising a first body panel hingedly connected along a common fold line to the first base panel, and a second body panel hingedly connected along a common fold line to the first body panel, and further comprising an attachment flap hingedly connected to the first body panel on an opposite side thereof from the second body panel, the body-forming portion having a width less than the length of the slot so as to permit the body-forming portion to extend through the slot, and one of the first and second body panels having a window therein for viewing of a graphic media item retained between the body panels.

11. The blank of claim 10, further comprising a connecting panel hingedly connected to the fourth base panel and defining an outer lengthwise extremity of the blank.

12. The blank of claim 10, wherein the first body panel has opposite side edges defining the width of the body-forming portion therebetween, and wherein the second body panel is hingedly connected to the first body panel along one of the side edges thereof.

13. The blank of claim 12, further comprising an attachment flap hingedly connected to the first body panel along the other side edge thereof.

14. The blank of claim 10, wherein the base panels are each generally rectangular having a length perpendicular to the slot and a width parallel to the slot, and wherein the sum of the lengths of the first and second base panels is substantially equal to the sum of the lengths of the third and fourth base panels.

15. The blank of claim 14, wherein the first and second body panels each has a length perpendicular to the slot which does not exceed the sum of the lengths of the first and second base panels.

16. The blank of claim 10, further comprising a locking tab formed in one of the body panels, the locking tab being bendable so as to project outwardly from said one of the body panels.

17. A display carrier for a graphic media item, comprising:

a base having opposing halves each formed of an upper panel and a lower panel hingedly connected together along outer ends of the panels, the upper panels also being hingedly connected together along inner ends thereof, central portions of the inner ends of the upper panels being spaced apart from each other to define an elongate slot therebetween; and an upright body portion comprising a first body panel hingedly connected along a first edge thereof to an inner edge of a first one of the lower panels, and a second body panel hingedly connected to the first body panel, the second body panel overlying the first body panel and being secured thereto to define a pocket adapted for reception therein of a graphic media item, the body panels extending upwardly through the slot and one of the first and second body panels having a window therein for viewing of the graphic media item, and further comprising a locking tab formed on the second body panel, the locking tab being bendable relative to the second body panel so as to project outwardly therefrom and engage an upper edge of one of the upper panels of the base adjacent the elongate slot, the locking tab thereby tending to prevent the body portion from being withdrawn through the slot into the base.

* * * * *

UNITED STATES PATENT AND TRADEMARK OFFICE
CERTIFICATE OF CORRECTION

PATENT NO. : 6,059,101

DATED : May 9, 2000

INVENTOR(S) : Gambardella et al.

It is certified that error appears in the above-identified patent and that said Letters Patent is hereby corrected as shown below:

Column 17, line 60, after "body" insert --panel--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*